US012312816B2

(12) United States Patent
Boo

(10) Patent No.: US 12,312,816 B2
(45) Date of Patent: May 27, 2025

(54) BUILDING PANEL WITH A MECHANICAL LOCKING SYSTEM

(71) Applicant: Välinge Innovation AB, Viken (SE)

(72) Inventor: Christian Boo, Kagerod (SE)

(73) Assignee: VÄLINGE INNOVATION AB, Viken (SE)

( * ) Notice: Subject to any disclaimer, the term of this patent is extended or adjusted under 35 U.S.C. 154(b) by 0 days.

(21) Appl. No.: 18/222,449

(22) Filed: Jul. 16, 2023

(65) Prior Publication Data

US 2024/0191515 A1 Jun. 13, 2024

Related U.S. Application Data

(60) Continuation of application No. 17/349,345, filed on Jun. 16, 2021, now Pat. No. 11,746,536, which is a (Continued)

(30) Foreign Application Priority Data

Jun. 27, 2013 (SE) ..... 1350783-5
Nov. 8, 2013 (SE) ..... 1351323-9

(51) Int. Cl.
*E04F 15/02* (2006.01)
*E04C 2/40* (2006.01)
*E04F 15/10* (2006.01)

(52) U.S. Cl.
CPC ..... *E04F 15/02038* (2013.01); *E04C 2/40* (2013.01); *E04F 15/102* (2013.01); *E04F 2201/0146* (2013.01); *E04F 2201/023* (2013.01); *E04F 2201/044* (2013.01); *E04F 2201/0535* (2013.01); *E04F 2201/0547* (2013.01); *E04F 2201/0552* (2013.01)

(58) Field of Classification Search
CPC ..... E04F 15/02038; E04F 15/102; E04F 2201/0146; E04F 2201/023; E04F 2201/044; E04F 2201/0535; E04F 2201/0547; E04F 2201/0552; E04C 2/40
USPC .. 52/588.1, 582.1, 578, 586.1, 586.2, 309.1, 52/391, 392
See application file for complete search history.

(56) References Cited

U.S. PATENT DOCUMENTS 87,853 A 3/1869 Kappes
108,068 A 10/1870 Utley
(Continued)

FOREIGN PATENT DOCUMENTS

CA 2456513 A1 2/2003
CN 1383464 A 12/2002
(Continued)

OTHER PUBLICATIONS

U.S. Appl. No. 18/635,607, Fredrik Boo, filed Apr. 15, 2024.
(Continued)

*Primary Examiner* — Brent W Herring
(74) *Attorney, Agent, or Firm* — Boone IP Law

(57) ABSTRACT

A set of essentially identical panels, such as building panels, provided with a mechanical locking system including a displaceable tongue, which is arranged in a displacement groove with a first opening at a first edge of a first panel. The displaceable tongue is configured to cooperate with a first tongue groove, with a second opening at a second edge of an adjacent second panel, for vertical locking of the first and the second edge. The height of the first opening is greater than a second height of the second opening.

19 Claims, 14 Drawing Sheets

Related U.S. Application Data continuation of application No. 16/419,660, filed on May 22, 2019, now Pat. No. 11,066,835, which is a continuation of application No. 15/365,546, filed on Nov. 30, 2016, now Pat. No. 10,352,049, which is a division of application No. 14/315,879, filed on Jun. 26, 2014, now Pat. No. 10,017,948.

(56) References Cited

U.S. PATENT DOCUMENTS

| | | | |
|---|---|---|---|
| 124,226 | A | 3/1872 | Shreffler |
| 124,228 | A | 3/1872 | Stuart |
| 213,740 | A | 4/1879 | Conner |
| 274,354 | A | 3/1883 | McCarthy |
| 316,176 | A | 4/1885 | Ransom |
| 634,581 | A | 10/1899 | Miller |
| 861,911 | A | 7/1907 | Stewart et al. |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,027,292 | A | 1/1936 | Rockwell |
| 2,110,728 | A | 3/1938 | Hoggatt |
| 2,142,305 | A | 1/1939 | Davis |
| 2,204,675 | A | 6/1940 | Grunert |
| 2,266,464 | A | 12/1941 | Kraft |
| 2,277,758 | A | 3/1942 | Hawkins |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,858,584 | A | 11/1958 | Gaines |
| 2,863,185 | A | 12/1958 | Riedi |
| 2,865,058 | A | 12/1958 | Ake et al. |
| 2,889,016 | A | 6/1959 | Warren |
| 3,023,681 | A | 3/1962 | Worson |
| 3,077,703 | A | 2/1963 | Bergstrom |
| 3,099,110 | A | 7/1963 | Spaight |
| 3,147,522 | A | 9/1964 | Schumm |
| 3,172,237 | A | 3/1965 | Bradley |
| 3,187,612 | A | 6/1965 | Hervey |
| 3,271,787 | A | 9/1966 | Clary |
| 3,276,797 | A | 10/1966 | Louis, Jr. |
| 3,308,588 | A | 3/1967 | Von Wedel |
| 3,325,585 | A | 6/1967 | Brenneman |
| 3,331,180 | A | 7/1967 | Friedrich et al. |
| 3,378,958 | A | 4/1968 | Parks et al. |
| 3,396,640 | A | 8/1968 | Fujihara |
| 3,512,324 | A | 5/1970 | Reed |
| 3,517,927 | A | 6/1970 | William |
| 3,526,071 | A | 9/1970 | Hiroshi |
| 3,535,844 | A | 10/1970 | Glaros |
| 3,572,224 | A | 3/1971 | Perry |
| 3,579,941 | A | 5/1971 | Tibbals |
| 3,626,822 | A | 12/1971 | Koster |
| 3,640,191 | A | 2/1972 | Hendrich |
| 3,694,983 | A | 10/1972 | Couquet |
| 3,720,027 | A | 3/1973 | Christensen |
| 3,722,379 | A | 3/1973 | Koester |
| 3,731,445 | A | 5/1973 | Hoffmann et al. |
| 3,742,669 | A | 7/1973 | Mansfeld |
| 3,760,547 | A | 9/1973 | Brenneman |
| 3,760,548 | A | 9/1973 | Sauer et al. |
| 3,764,767 | A | 10/1973 | Randolph |
| 3,778,954 | A | 12/1973 | Meserole |
| 3,849,235 | A | 11/1974 | Gwynne |
| 3,919,820 | A | 11/1975 | Green |
| 3,950,915 | A | 4/1976 | Cole |
| 3,994,609 | A | 11/1976 | Puccio |
| 4,007,767 | A | 2/1977 | Colledge |
| 4,007,994 | A | 2/1977 | Brown |
| 4,030,852 | A | 6/1977 | Hein |
| 4,037,377 | A | 7/1977 | Howell et al. |
| 4,041,665 | A | 8/1977 | De Munck |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,104,840 | A | 8/1978 | Heintz et al. |
| 4,107,892 | A | 8/1978 | Bellem |
| 4,113,399 | A | 9/1978 | Hansen, Sr. |
| 4,154,041 | A | 5/1979 | Namy |
| 4,169,688 | A | 10/1979 | Toshio |
| RE30,154 | E | 11/1979 | Jarvis |
| 4,196,554 | A | 4/1980 | Anderson et al. |
| 4,227,430 | A | 10/1980 | Jansson et al. |
| 4,299,070 | A | 11/1981 | Oltmanns et al. |
| 4,304,083 | A | 12/1981 | Anderson |
| 4,426,820 | A | 1/1984 | Terbrack et al. |
| 4,447,172 | A | 5/1984 | Galbreath |
| 4,512,131 | A | 4/1985 | Laramore |
| 4,599,841 | A | 7/1986 | Haid |
| 4,622,784 | A | 11/1986 | Black et al. |
| 4,648,165 | A | 3/1987 | Whitehorne |
| 4,819,932 | A | 4/1989 | Trotter, Jr. |
| 4,948,716 | A | 8/1990 | Mihayashi et al. |
| 4,998,395 | A | 3/1991 | Bezner |
| 5,007,222 | A | 4/1991 | Raymond |
| 5,026,112 | A | 6/1991 | Rice |
| 5,071,282 | A | 12/1991 | Brown |
| 5,135,597 | A | 8/1992 | Barker |
| 5,148,850 | A | 9/1992 | Urbanick |
| 5,173,012 | A | 12/1992 | Ortwein et al. |
| 5,182,892 | A | 2/1993 | Chase |
| 5,247,773 | A | 9/1993 | Weir |
| 5,272,850 | A | 12/1993 | Mysliwiec et al. |
| 5,274,979 | A | 1/1994 | Tsai |
| 5,281,055 | A | 1/1994 | Neitzke et al. |
| 5,293,728 | A | 3/1994 | Christopher et al. |
| 5,295,341 | A | 3/1994 | Kajiwara |
| 5,344,700 | A | 9/1994 | McGath et al. |
| 5,348,778 | A | 9/1994 | Knipp et al. |
| 5,373,674 | A | 12/1994 | Winter, IV |
| 5,465,546 | A | 11/1995 | Buse |
| 5,485,702 | A | 1/1996 | Sholton |
| 5,502,939 | A | 4/1996 | Zadok et al. |
| 5,548,937 | A | 8/1996 | Shimonohara |
| 5,577,357 | A | 11/1996 | Civelli |
| 5,587,218 | A | 12/1996 | Betz |
| 5,598,682 | A | 2/1997 | Haughian |
| 5,616,389 | A | 4/1997 | Blatz |
| 5,618,602 | A | 4/1997 | Nelson |
| 5,634,309 | A | 6/1997 | Polen |
| 5,658,086 | A | 8/1997 | Brokaw et al. |
| 5,694,730 | A | 12/1997 | Del et al. |
| 5,755,068 | A | 5/1998 | Ormiston |
| 5,860,267 | A | 1/1999 | Pervan |
| 5,899,038 | A | 5/1999 | Stroppiana |
| 5,910,084 | A | 6/1999 | Koike et al. |
| 5,950,389 | A | 9/1999 | Porter |
| 5,970,675 | A | 10/1999 | Schray |
| 6,006,486 | A | 12/1999 | Moriau et al. |
| 6,029,416 | A | 2/2000 | Andersson |
| 6,052,960 | A | 4/2000 | Yonemura |
| 6,065,262 | A | 5/2000 | Motta |
| 6,098,354 | A | 8/2000 | Skandis |
| 6,122,879 | A | 9/2000 | Montes |
| 6,134,854 | A | 10/2000 | Stanchfield |
| 6,145,261 | A | 11/2000 | Godfrey et al. |
| 6,164,618 | A | 12/2000 | Yonemura |
| 6,173,548 | B1 | 1/2001 | Hamar et al. |
| 6,182,410 | B1 | 2/2001 | Pervan |
| 6,203,653 | B1 | 3/2001 | Seidner |
| 6,210,512 | B1 | 4/2001 | Jones |
| 6,254,301 | B1 | 7/2001 | Hatch |
| 6,295,779 | B1 | 10/2001 | Canfield |
| 6,314,701 | B1 | 11/2001 | Meyerson |
| 6,324,796 | B1 | 12/2001 | Heath |
| 6,324,809 | B1 | 12/2001 | Nelson |
| 6,332,733 | B1 | 12/2001 | Hamberger et al. |
| 6,339,908 | B1 | 1/2002 | Chuang |
| 6,345,481 | B1 | 2/2002 | Nelson |

(56) References Cited

U.S. PATENT DOCUMENTS

| | | | |
|---|---|---|---|
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,405 | B1 | 9/2002 | Pervan |
| 6,446,413 | B1 | 9/2002 | Gruber |
| 6,449,918 | B1 | 9/2002 | Nelson et al. |
| 6,450,235 | B1 | 9/2002 | Lee |
| 6,490,836 | B1 | 12/2002 | Moriau et al. |
| 6,503,970 | B1 | 1/2003 | Valin |
| 6,505,452 | B1 | 1/2003 | Hannig et al. |
| 6,546,691 | B2 | 4/2003 | Leopolder |
| 6,553,724 | B1 | 4/2003 | Bigler |
| 6,576,079 | B1 | 6/2003 | Kai |
| 6,584,747 | B2 | 7/2003 | Kettler et al. |
| 6,588,166 | B2 | 7/2003 | Martensson et al. |
| 6,591,568 | B1 | 7/2003 | Joergen |
| 6,601,359 | B2 | 8/2003 | Olofsson |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,651,400 | B1 | 11/2003 | Murphy |
| 6,670,019 | B2 | 12/2003 | Andersson |
| 6,672,030 | B2 | 1/2004 | Schulte |
| 6,681,820 | B2 | 1/2004 | Olofsson |
| 6,682,254 | B1 | 1/2004 | Olofsson et al. |
| 6,684,592 | B2 | 2/2004 | Martin |
| 6,685,391 | B1 | 2/2004 | Gideon |
| 6,729,091 | B1 | 5/2004 | Martensson |
| 6,763,643 | B1 | 7/2004 | Maartensson |
| 6,766,622 | B1 | 7/2004 | Thiers |
| 6,769,218 | B2 | 8/2004 | Pervan |
| 6,769,219 | B2 | 8/2004 | Schwitte et al. |
| 6,769,835 | B2 | 8/2004 | Stridsman |
| 6,802,166 | B1 | 10/2004 | Gerhard |
| 6,804,926 | B1 | 10/2004 | Eisermann |
| 6,808,777 | B2 | 10/2004 | Andersson et al. |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,880,307 | B2 | 4/2005 | Schwitte et al. |
| 6,948,716 | B2 | 9/2005 | Drouin |
| 7,021,019 | B2 | 4/2006 | Knauseder |
| 7,040,068 | B2 | 5/2006 | Moriau et al. |
| 7,051,486 | B2 | 5/2006 | Pervan |
| 7,108,031 | B1 | 9/2006 | Secrest |
| 7,121,058 | B2 | 10/2006 | Palsson et al. |
| 7,152,383 | B1 | 12/2006 | Wilkinson et al. |
| 7,156,383 | B1 | 1/2007 | Jacobs |
| 7,188,456 | B2 | 3/2007 | Knauseder |
| 7,219,392 | B2 | 5/2007 | Mullet et al. |
| 7,251,916 | B2 | 8/2007 | Konzelmann et al. |
| 7,257,926 | B1 | 8/2007 | Kirby |
| 7,337,588 | B1 | 3/2008 | Moebus |
| 7,377,081 | B2 | 5/2008 | Ruhdorfer |
| 7,380,383 | B2 | 6/2008 | Olofsson et al. |
| 7,441,384 | B2 | 10/2008 | Miller et al. |
| 7,451,578 | B2 | 11/2008 | Hannig |
| 7,454,875 | B2 | 11/2008 | Pervan et al. |
| 7,516,588 | B2 | 4/2009 | Pervan |
| 7,517,427 | B2 | 4/2009 | Sjoberg et al. |
| 7,520,092 | B2 | 4/2009 | Showers et al. |
| 7,533,500 | B2 | 5/2009 | Morton et al. |
| 7,556,849 | B2 | 7/2009 | Thompson et al. |
| 7,568,322 | B2 | 8/2009 | Pervan |
| 7,584,583 | B2 | 9/2009 | Bergelin et al. |
| 7,591,116 | B2 | 9/2009 | Thiers et al. |
| 7,614,197 | B2 | 11/2009 | Nelson |
| 7,617,651 | B2 | 11/2009 | Grafenauer |
| 7,621,092 | B2 | 11/2009 | Groeke et al. |
| 7,621,094 | B2 | 11/2009 | Moriau et al. |
| 7,634,884 | B2 | 12/2009 | Pervan et al. |
| 7,637,068 | B2 | 12/2009 | Pervan |
| 7,644,553 | B2 | 1/2010 | Knauseder |
| 7,654,055 | B2 | 2/2010 | Ricker |
| 7,677,005 | B2 | 3/2010 | Pervan |
| 7,716,889 | B2 | 5/2010 | Pervan |
| 7,721,503 | B2 | 5/2010 | Pervan et al. |
| 7,726,088 | B2 | 6/2010 | Muehlebach |
| 7,748,176 | B2 | 7/2010 | Harding et al. |
| 7,757,452 | B2 | 7/2010 | Pervan |
| 7,802,411 | B2 | 9/2010 | Pervan et al. |
| 7,806,624 | B2 | 10/2010 | McLean et al. |
| 7,827,749 | B2 | 11/2010 | Groeke et al. |
| 7,841,144 | B2 | 11/2010 | Pervan |
| 7,841,145 | B2 | 11/2010 | Pervan et al. |
| 7,841,150 | B2 | 11/2010 | Pervan |
| 7,849,642 | B2 | 12/2010 | Forster et al. |
| 7,856,789 | B2 | 12/2010 | Eisermann |
| 7,861,482 | B2 | 1/2011 | Pervan et al. |
| 7,866,110 | B2 | 1/2011 | Pervan |
| 7,896,571 | B1 | 3/2011 | Hannig et al. |
| 7,900,416 | B1 | 3/2011 | Yokubison et al. |
| 7,908,815 | B2 | 3/2011 | Pervan et al. |
| 7,908,816 | B2 | 3/2011 | Grafenauer et al. |
| 7,913,471 | B2 | 3/2011 | Pervan |
| 7,930,862 | B2 | 4/2011 | Bergelin et al. |
| 7,954,295 | B2 | 6/2011 | Pervan |
| 7,964,133 | B2 | 6/2011 | Cappelle et al. |
| 7,980,039 | B2 | 7/2011 | Groeke et al. |
| 7,980,041 | B2 | 7/2011 | Pervan et al. |
| 8,001,741 | B2 | 8/2011 | Duernberger |
| 8,006,458 | B1 | 8/2011 | Olofsson et al. |
| 8,033,074 | B2 | 10/2011 | Pervan et al. |
| 8,042,311 | B2 | 10/2011 | Pervan et al. |
| 8,061,104 | B2 | 11/2011 | Pervan |
| 8,079,196 | B2 | 12/2011 | Pervan |
| 8,112,967 | B2 | 2/2012 | Pervan et al. |
| 8,171,692 | B2 | 5/2012 | Pervan |
| 8,181,416 | B2 | 5/2012 | Pervan et al. |
| 8,191,334 | B2 | 6/2012 | Braun |
| 8,220,217 | B2 | 7/2012 | Muehlebach |
| 8,234,830 | B2 | 8/2012 | Pervan et al. |
| 8,245,478 | B2 | 8/2012 | Bergelin et al. |
| 8,281,549 | B2 | 10/2012 | Du |
| 8,302,367 | B2 | 11/2012 | Schulte |
| 8,336,272 | B2 | 12/2012 | Prager et al. |
| 8,341,914 | B2 | 1/2013 | Pervan et al. |
| 8,341,915 | B2 | 1/2013 | Pervan et al. |
| 8,353,140 | B2 | 1/2013 | Pervan et al. |
| 8,359,794 | B2 | 1/2013 | Biro et al. |
| 8,359,805 | B2 | 1/2013 | Pervan et al. |
| 8,365,499 | B2 | 2/2013 | Nilsson et al. |
| 8,375,673 | B2 | 2/2013 | Evjen |
| 8,381,476 | B2 | 2/2013 | Hannig |
| 8,381,477 | B2 | 2/2013 | Pervan et al. |
| 8,387,327 | B2 | 3/2013 | Pervan |
| 8,448,402 | B2 | 5/2013 | Pervan et al. |
| 8,499,521 | B2 | 8/2013 | Pervan et al. |
| 8,505,257 | B2 | 8/2013 | Boo et al. |
| 8,511,031 | B2 | 8/2013 | Bergelin et al. |
| 8,522,505 | B2 | 9/2013 | Beach et al. |
| 8,528,289 | B2 | 9/2013 | Pervan et al. |
| 8,544,230 | B2 | 10/2013 | Pervan |
| 8,544,232 | B2 | 10/2013 | Wybo et al. |
| 8,544,233 | B2 | 10/2013 | Palsson et al. |
| 8,544,234 | B2 | 10/2013 | Pervan et al. |
| 8,572,922 | B2 | 11/2013 | Pervan |
| 8,578,675 | B2 | 11/2013 | Palsson et al. |
| 8,590,250 | B2 | 11/2013 | Oh |
| 8,596,013 | B2 | 12/2013 | Boo |
| 8,615,952 | B2 | 12/2013 | Engstrom |
| 8,621,814 | B2 | 1/2014 | Cappelle |
| 8,627,862 | B2 | 1/2014 | Pervan et al. |
| 8,631,623 | B2 | 1/2014 | Engstroem |
| 8,635,829 | B2 | 1/2014 | Schulte |
| 8,640,418 | B2 | 2/2014 | Paetrow et al. |
| 8,640,424 | B2 | 2/2014 | Pervan et al. |
| 8,650,826 | B2 | 2/2014 | Pervan et al. |
| 8,677,714 | B2 | 3/2014 | Pervan |
| 8,689,512 | B2 | 4/2014 | Pervan |
| 8,701,368 | B2 | 4/2014 | Vermeulen et al. |
| 8,707,650 | B2 | 4/2014 | Pervan et al. |

(56) References Cited

U.S. PATENT DOCUMENTS

| | | | |
|---|---|---|---|
| 8,713,886 | B2 | 5/2014 | Pervan et al. |
| 8,733,065 | B2 | 5/2014 | Pervan |
| 8,733,410 | B2 | 5/2014 | Pervan |
| 8,763,341 | B2 | 7/2014 | Pervan |
| 8,769,905 | B2 | 7/2014 | Pervan et al. |
| 8,776,473 | B2 | 7/2014 | Pervan et al. |
| 8,806,832 | B2 | 8/2014 | Kell |
| 8,833,026 | B2 | 9/2014 | Devos et al. |
| 8,844,236 | B2 | 9/2014 | Pervan et al. |
| 8,857,126 | B2 | 10/2014 | Pervan et al. |
| 8,869,485 | B2 | 10/2014 | Pervan |
| 8,887,468 | B2 | 11/2014 | Hakansson et al. |
| 8,898,988 | B2 | 12/2014 | Pervan |
| 8,925,274 | B2 | 1/2015 | Darko et al. |
| 8,938,929 | B2 | 1/2015 | Engstrm |
| 8,959,866 | B2 | 2/2015 | Pervan |
| 8,973,331 | B2 | 3/2015 | Boo |
| 8,991,055 | B2 | 3/2015 | Cappelle |
| 8,997,423 | B2 | 4/2015 | Mann |
| 8,997,430 | B1 | 4/2015 | Vermeulen et al. |
| 9,027,306 | B2 | 5/2015 | Pervan |
| 9,051,738 | B2 | 6/2015 | Pervan et al. |
| 9,068,360 | B2 | 6/2015 | Darko |
| 9,080,329 | B2 | 7/2015 | Dhring et al. |
| 9,091,077 | B2 | 7/2015 | Boo |
| 9,103,126 | B2 | 8/2015 | Kell |
| 9,103,128 | B2 | 8/2015 | Pomberger |
| 9,151,062 | B2 | 10/2015 | Cappelle et al. |
| 9,181,697 | B2 | 11/2015 | Masanek et al. |
| 9,194,134 | B2 | 11/2015 | Nygren et al. |
| 9,206,611 | B2 | 12/2015 | Vermeulen et al. |
| 9,212,492 | B2 | 12/2015 | Pervan et al. |
| 9,216,541 | B2 | 12/2015 | Boo et al. |
| 9,238,917 | B2 | 1/2016 | Pervan et al. |
| 9,284,737 | B2 | 3/2016 | Pervan et al. |
| 9,290,948 | B2 | 3/2016 | Cappelle et al. |
| 9,309,679 | B2 | 4/2016 | Pervan et al. |
| 9,316,002 | B2 | 4/2016 | Boo |
| 9,340,974 | B2 | 5/2016 | Pervan et al. |
| 9,347,227 | B2 | 5/2016 | Ramachandra et al. |
| 9,347,469 | B2 | 5/2016 | Pervan et al. |
| 9,359,774 | B2 | 6/2016 | Pervan |
| 9,366,034 | B2 | 6/2016 | Meirlaen et al. |
| 9,366,036 | B2 | 6/2016 | Pervan |
| 9,371,654 | B2 | 6/2016 | Cappelle |
| 9,376,821 | B2 | 6/2016 | Pervan et al. |
| 9,382,716 | B2 | 7/2016 | Pervan et al. |
| 9,388,584 | B2 | 7/2016 | Pervan et al. |
| 9,428,919 | B2 | 8/2016 | Pervan et al. |
| 9,453,347 | B2 | 9/2016 | Pervan |
| 9,458,634 | B2 | 10/2016 | Derelov |
| 9,476,202 | B2 | 10/2016 | Clancy et al. |
| 9,482,012 | B2 | 11/2016 | Nygren et al. |
| 9,540,825 | B2 | 1/2017 | Ramachandra |
| 9,540,826 | B2 | 1/2017 | Pervan et al. |
| 9,663,940 | B2 | 5/2017 | Boo |
| 9,725,912 | B2 | 8/2017 | Pervan |
| 9,771,723 | B2 | 9/2017 | Pervan |
| 9,777,487 | B2 | 10/2017 | Pervan et al. |
| 9,803,374 | B2 | 10/2017 | Pervan |
| 9,803,375 | B2 | 10/2017 | Pervan |
| 9,822,533 | B2 | 11/2017 | Huang |
| 9,856,656 | B2 | 1/2018 | Pervan |
| 9,874,027 | B2 | 1/2018 | Pervan et al. |
| 9,945,130 | B2 | 4/2018 | Nygren et al. |
| 9,951,526 | B2 | 4/2018 | Boo et al. |
| 10,000,935 | B2 | 6/2018 | Kell |
| 10,006,210 | B2 | 6/2018 | Pervan et al. |
| 10,017,948 | B2 | 7/2018 | Boo |
| 10,113,319 | B2 | 10/2018 | Pervan |
| 10,125,488 | B2 | 11/2018 | Boo |
| 10,138,636 | B2 | 11/2018 | Pervan |
| 10,161,139 | B2 | 12/2018 | Pervan |
| 10,180,005 | B2 | 1/2019 | Pervan et al. |
| 10,214,915 | B2 | 2/2019 | Pervan et al. |
| 10,214,917 | B2 | 2/2019 | Pervan et al. |
| 10,240,348 | B2 | 3/2019 | Pervan et al. |
| 10,240,349 | B2 | 3/2019 | Pervan et al. |
| 10,246,883 | B2 | 4/2019 | Derelov |
| 10,352,049 | B2 | 7/2019 | Boo |
| 10,358,830 | B2 | 7/2019 | Pervan |
| 10,378,217 | B2 | 8/2019 | Pervan |
| 10,458,125 | B2 | 10/2019 | Pervan |
| 10,480,196 | B2 | 11/2019 | Boo |
| 10,519,676 | B2 | 12/2019 | Pervan |
| 10,526,792 | B2 | 1/2020 | Pervan et al. |
| 10,538,922 | B2 | 1/2020 | Pervan |
| 10,570,625 | B2 | 2/2020 | Pervan |
| 10,640,989 | B2 | 5/2020 | Pervan |
| 10,655,339 | B2 | 5/2020 | Pervan |
| 10,669,723 | B2 | 6/2020 | Pervan et al. |
| 10,724,251 | B2 | 7/2020 | Kell |
| 10,731,358 | B2 | 8/2020 | Pervan |
| 10,794,065 | B2 | 10/2020 | Boo et al. |
| 10,828,798 | B2 | 11/2020 | Fransson |
| 10,933,592 | B2 | 3/2021 | Blomgren et al. |
| 10,934,721 | B2 | 3/2021 | Pervan et al. |
| 10,953,566 | B2 | 3/2021 | Fransson et al. |
| 10,968,639 | B2 | 4/2021 | Pervan et al. |
| 10,975,577 | B2 | 4/2021 | Pervan et al. |
| 10,995,501 | B2 | 5/2021 | Pervan |
| 11,045,933 | B2 | 6/2021 | Fransson et al. |
| 11,053,691 | B2 | 7/2021 | Pervan |
| 11,053,692 | B2 | 7/2021 | Pervan |
| 11,060,302 | B2 | 7/2021 | Ylikangas et al. |
| 11,066,835 | B2 | 7/2021 | Boo |
| 11,078,673 | B2 | 8/2021 | Pervan et al. |
| 11,091,920 | B2 | 8/2021 | Kell |
| 11,131,099 | B2 | 9/2021 | Pervan |
| 11,174,646 | B2 | 11/2021 | Pervan |
| 11,193,283 | B2 | 12/2021 | Pervan et al. |
| 11,261,608 | B2 | 3/2022 | Pervan |
| 11,274,453 | B2 | 3/2022 | Pervan |
| 11,326,353 | B2 | 5/2022 | Nilsson et al. |
| 11,331,824 | B2 | 5/2022 | Myllykangas et al. |
| 11,359,381 | B2 | 6/2022 | Sieder et al. |
| 2001/0024707 | A1 | 9/2001 | Andersson et al. |
| 2001/0034991 | A1 | 11/2001 | Martensson et al. |
| 2001/0045150 | A1 | 11/2001 | Owens |
| 2002/0014047 | A1 | 2/2002 | Thiers |
| 2002/0031646 | A1 | 3/2002 | Chen et al. |
| 2002/0069611 | A1 | 6/2002 | Leopolder |
| 2002/0092263 | A1 | 7/2002 | Schulte |
| 2002/0095894 | A1 | 7/2002 | Pervan |
| 2002/0108343 | A1 | 8/2002 | Knauseder |
| 2002/0170258 | A1 | 11/2002 | Schwitte et al. |
| 2002/0170259 | A1 | 11/2002 | Ferris |
| 2002/0178674 | A1 | 12/2002 | Pervan |
| 2002/0178680 | A1 | 12/2002 | Martensson et al. |
| 2002/0189190 | A1 | 12/2002 | Charmat et al. |
| 2002/0189747 | A1 | 12/2002 | Steinwender |
| 2002/0194807 | A1 | 12/2002 | Nelson et al. |
| 2003/0009971 | A1 | 1/2003 | Palmberg |
| 2003/0024199 | A1 | 2/2003 | Pervan et al. |
| 2003/0037504 | A1 | 2/2003 | Schwitte et al. |
| 2003/0066588 | A1 | 4/2003 | Palsson et al. |
| 2003/0084636 | A1 | 5/2003 | Pervan |
| 2003/0094230 | A1 | 5/2003 | Sjoberg |
| 2003/0101674 | A1 | 6/2003 | Pervan et al. |
| 2003/0101681 | A1 | 6/2003 | Tychsen |
| 2003/0145549 | A1 | 8/2003 | Palsson et al. |
| 2003/0154681 | A1 | 8/2003 | Pletzer et al. |
| 2003/0180091 | A1 | 9/2003 | Stridsman |
| 2003/0182310 | A1 | 9/2003 | Charnock et al. |
| 2003/0188504 | A1 | 10/2003 | Ralf |
| 2003/0196405 | A1 | 10/2003 | Pervan |
| 2004/0016196 | A1 | 1/2004 | Pervan |
| 2004/0031225 | A1 | 2/2004 | Fowler |
| 2004/0031227 | A1 | 2/2004 | Knauseder |
| 2004/0049999 | A1 | 3/2004 | Krieger |
| 2004/0060255 | A1 | 4/2004 | Knauseder |
| 2004/0068954 | A1 | 4/2004 | Martensson |
| 2004/0123548 | A1 | 7/2004 | Gimpel et al. |
| 2004/0128934 | A1 | 7/2004 | Hecht |

(56) References Cited

U.S. PATENT DOCUMENTS

| | | | |
|---|---|---|---|
| 2004/0137180 | A1 | 7/2004 | Sjoberg et al. |
| 2004/0139676 | A1 | 7/2004 | Knauseder |
| 2004/0139678 | A1 | 7/2004 | Pervan |
| 2004/0159066 | A1 | 8/2004 | Thiers et al. |
| 2004/0168392 | A1 | 9/2004 | Konzelmann et al. |
| 2004/0177584 | A1 | 9/2004 | Pervan |
| 2004/0182033 | A1 | 9/2004 | Wernersson |
| 2004/0182036 | A1 | 9/2004 | Sjoberg et al. |
| 2004/0200175 | A1 | 10/2004 | Weber |
| 2004/0211143 | A1 | 10/2004 | Hanning |
| 2004/0238001 | A1 | 12/2004 | Risden |
| 2004/0244325 | A1 | 12/2004 | Nelson |
| 2004/0250492 | A1 | 12/2004 | Becker |
| 2004/0261348 | A1 | 12/2004 | Vulin |
| 2005/0003132 | A1 | 1/2005 | Blix et al. |
| 2005/0028474 | A1 | 2/2005 | Kim |
| 2005/0050827 | A1 | 3/2005 | Schitter |
| 2005/0160694 | A1 | 7/2005 | Pervan |
| 2005/0166514 | A1 | 8/2005 | Pervan |
| 2005/0183370 | A1 | 8/2005 | Cripps |
| 2005/0205161 | A1 | 9/2005 | Lewark |
| 2005/0210810 | A1 | 9/2005 | Pervan |
| 2005/0235593 | A1 | 10/2005 | Hecht |
| 2005/0252130 | A1 | 11/2005 | Martensson |
| 2005/0252167 | A1 | 11/2005 | Van Horne |
| 2005/0268570 | A2 | 12/2005 | Pervan |
| 2006/0053724 | A1 | 3/2006 | Braun et al. |
| 2006/0064940 | A1 | 3/2006 | Cappelle |
| 2006/0070333 | A1 | 4/2006 | Pervan |
| 2006/0101769 | A1 | 5/2006 | Pervan et al. |
| 2006/0156670 | A1 | 7/2006 | Knauseder |
| 2006/0174577 | A1 | 8/2006 | O'Neil |
| 2006/0179754 | A1 | 8/2006 | Yang |
| 2006/0185287 | A1 | 8/2006 | Glazer et al. |
| 2006/0236642 | A1 | 10/2006 | Pervan |
| 2006/0260254 | A1 | 11/2006 | Pervan |
| 2006/0272262 | A1 | 12/2006 | Pomberger |
| 2007/0003366 | A1 | 1/2007 | Wedberg |
| 2007/0006543 | A1 | 1/2007 | Engstrom |
| 2007/0011981 | A1 | 1/2007 | Eisermann |
| 2007/0022689 | A1 | 2/2007 | Thrush et al. |
| 2007/0028547 | A1 | 2/2007 | Grafenauer et al. |
| 2007/0065293 | A1 | 3/2007 | Hannig |
| 2007/0094969 | A1 | 5/2007 | McIntosh et al. |
| 2007/0094985 | A1 | 5/2007 | Grafenauer |
| 2007/0108679 | A1 | 5/2007 | Grothaus |
| 2007/0113509 | A1 | 5/2007 | Zhang |
| 2007/0151189 | A1 | 7/2007 | Yang |
| 2007/0175156 | A1 | 8/2007 | Pervan et al. |
| 2007/0193178 | A1 | 8/2007 | Groeke et al. |
| 2007/0209736 | A1 | 9/2007 | Deringor et al. |
| 2007/0214741 | A1 | 9/2007 | Llorens Miravet |
| 2008/0000182 | A1 | 1/2008 | Pervan |
| 2008/0000185 | A1 | 1/2008 | Duernberger |
| 2008/0000186 | A1 | 1/2008 | Pervan et al. |
| 2008/0000187 | A1 | 1/2008 | Pervan |
| 2008/0005998 | A1 | 1/2008 | Pervan |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0053029 | A1 | 3/2008 | Ricker |
| 2008/0066415 | A1 | 3/2008 | Pervan et al. |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0134614 | A1 | 6/2008 | Pervan et al. |
| 2008/0155930 | A1 | 7/2008 | Pervan et al. |
| 2008/0184646 | A1 | 8/2008 | Alford et al. |
| 2008/0199676 | A1 | 8/2008 | Bathelier et al. |
| 2008/0216434 | A1 | 9/2008 | Pervan |
| 2008/0216920 | A1 | 9/2008 | Pervan |
| 2008/0236088 | A1 | 10/2008 | Hannig |
| 2008/0246499 | A1 | 10/2008 | Kollwitz et al. |
| 2008/0295432 | A1 | 12/2008 | Pervan et al. |
| 2008/0295438 | A1 | 12/2008 | Knauseder |
| 2008/0302044 | A1 | 12/2008 | Johansson |
| 2009/0019806 | A1 | 1/2009 | Muehlebach |
| 2009/0030097 | A1 | 1/2009 | Knott et al. |
| 2009/0049787 | A1 | 2/2009 | Hannig |
| 2009/0064624 | A1 | 3/2009 | Sokol |
| 2009/0100782 | A1 | 4/2009 | Groeke et al. |
| 2009/0126308 | A1 | 5/2009 | Hannig et al. |
| 2009/0133353 | A1 | 5/2009 | Pervan et al. |
| 2009/0151290 | A1 | 6/2009 | Liu |
| 2009/0173032 | A1 | 7/2009 | Prager et al. |
| 2009/0193741 | A1 | 8/2009 | Cappelle |
| 2009/0193748 | A1 | 8/2009 | Boo et al. |
| 2009/0193753 | A1 | 8/2009 | Schitter |
| 2009/0217615 | A1 | 9/2009 | Engstrom |
| 2009/0241460 | A1 | 10/2009 | Beaulieu |
| 2009/0249733 | A1 | 10/2009 | Moebus |
| 2009/0308014 | A1 | 12/2009 | Muehlebach |
| 2010/0018149 | A1 | 1/2010 | Thiers |
| 2010/0043333 | A1 | 2/2010 | Hannig |
| 2010/0083603 | A1 | 4/2010 | Goodwin |
| 2010/0170189 | A1 | 7/2010 | Schulte |
| 2010/0173122 | A1 | 7/2010 | Susnjara |
| 2010/0218450 | A1 | 9/2010 | Braun et al. |
| 2010/0275541 | A1 | 11/2010 | Prinz |
| 2010/0281803 | A1 | 11/2010 | Cappelle |
| 2010/0293879 | A1 | 11/2010 | Pervan et al. |
| 2010/0300029 | A1 | 12/2010 | Braun et al. |
| 2010/0300031 | A1 | 12/2010 | Pervan et al. |
| 2010/0313510 | A1 | 12/2010 | Tang |
| 2010/0319290 | A1 | 12/2010 | Pervan et al. |
| 2010/0319291 | A1 | 12/2010 | Pervan et al. |
| 2011/0016815 | A1 | 1/2011 | Yang |
| 2011/0030303 | A1 | 2/2011 | Pervan et al. |
| 2011/0041996 | A1 | 2/2011 | Pervan |
| 2011/0047922 | A1 | 3/2011 | Fleming, III |
| 2011/0088344 | A1 | 4/2011 | Pervan et al. |
| 2011/0088345 | A1 | 4/2011 | Pervan |
| 2011/0088346 | A1 | 4/2011 | Hannig |
| 2011/0094178 | A1 | 4/2011 | Braun |
| 2011/0131916 | A1 | 6/2011 | Chen et al. |
| 2011/0138722 | A1 | 6/2011 | Hannig |
| 2011/0154763 | A1 | 6/2011 | Bergelin et al. |
| 2011/0162312 | A1 | 7/2011 | Schulte |
| 2011/0167744 | A1 | 7/2011 | Whispell et al. |
| 2011/0167750 | A1 | 7/2011 | Pervan |
| 2011/0167751 | A1 | 7/2011 | Engstrom |
| 2011/0173914 | A1 | 7/2011 | Engstrom |
| 2011/0197535 | A1 | 8/2011 | Baker et al. |
| 2011/0225921 | A1 | 9/2011 | Schulte |
| 2011/0225922 | A1 | 9/2011 | Pervan et al. |
| 2011/0247285 | A1 | 10/2011 | Wybo et al. |
| 2011/0252733 | A1 | 10/2011 | Pervan et al. |
| 2011/0271631 | A1 | 11/2011 | Engstrom |
| 2011/0271632 | A1 | 11/2011 | Cappelle et al. |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0042598 | A1 | 2/2012 | Vermeulen et al. |
| 2012/0055112 | A1 | 3/2012 | Engstrom |
| 2012/0124932 | A1 | 5/2012 | Schulte et al. |
| 2012/0151865 | A1 | 6/2012 | Pervan et al. |
| 2012/0174515 | A1 | 7/2012 | Pervan et al. |
| 2012/0174519 | A1 | 7/2012 | Schulte |
| 2012/0174520 | A1 | 7/2012 | Pervan |
| 2012/0174521 | A1 | 7/2012 | Schulte |
| 2012/0192521 | A1 | 8/2012 | Schulte |
| 2012/0222378 | A1 | 9/2012 | Cappelle et al. |
| 2012/0240502 | A1 | 9/2012 | Wilson et al. |
| 2012/0279161 | A1 | 11/2012 | Hakansson et al. |
| 2012/0304590 | A1 | 12/2012 | Engstrom |
| 2012/0324816 | A1 | 12/2012 | Huang |
| 2013/0008117 | A1 | 1/2013 | Pervan |
| 2013/0008118 | A1 | 1/2013 | Baert et al. |
| 2013/0014463 | A1 | 1/2013 | Pervan |
| 2013/0019555 | A1 | 1/2013 | Pervan et al. |

(56) References Cited

U.S. PATENT DOCUMENTS

2013/0025231 A1 1/2013 Vermeulen et al.
2013/0025964 A1 1/2013 Ramachandra et al.
2013/0042562 A1 2/2013 Pervan et al.
2013/0042563 A1 2/2013 Pervan et al.
2013/0042564 A1 2/2013 Pervan et al.
2013/0042565 A1 2/2013 Pervan et al.
2013/0047536 A1 2/2013 Pervan
2013/0081349 A1 4/2013 Pervan et al.
2013/0111837 A1 5/2013 Devos et al.
2013/0111845 A1 5/2013 Pervan et al.
2013/0145708 A1 6/2013 Pervan
2013/0152500 A1 6/2013 Engstroem
2013/0160391 A1 6/2013 Pervan et al.
2013/0167467 A1 7/2013 Vermeulen et al.
2013/0219806 A1 8/2013 Carrubba
2013/0232905 A2 9/2013 Pervan
2013/0239508 A1 9/2013 Darko et al.
2013/0263454 A1 10/2013 Boo et al.
2013/0263547 A1 10/2013 Boo
2013/0283719 A1 10/2013 Doehring et al.
2013/0305650 A1 11/2013 Liu
2013/0309441 A1 11/2013 Hannig
2013/0318906 A1 12/2013 Pervan et al.
2014/0007539 A1 1/2014 Pervan et al.
2014/0020324 A1 1/2014 Pervan
2014/0026513 A1 1/2014 Bishop
2014/0033630 A1 2/2014 Engstrom
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090331 A1 4/2014 Pervan et al.
2014/0090335 A1 4/2014 Pervan et al.
2014/0109501 A1 4/2014 Darko
2014/0109506 A1 4/2014 Pervan et al.
2014/0123586 A1 5/2014 Pervan et al.
2014/0130437 A1 5/2014 Cappelle
2014/0140766 A1 5/2014 Riccobene et al.
2014/0144096 A1 5/2014 Vermeulen et al.
2014/0150369 A1 6/2014 Hannig
2014/0186104 A1 7/2014 Hamberger
2014/0190112 A1 7/2014 Pervan et al.
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0283466 A1 9/2014 Boo
2014/0290173 A1 10/2014 Hamberger
2014/0305065 A1 10/2014 Pervan
2014/0338177 A1 11/2014 Vermeulen et al.
2014/0366476 A1 12/2014 Pervan et al.
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0047278 A1 2/2015 Blount
2015/0047284 A1 2/2015 Cappelle et al.
2015/0059281 A1 3/2015 Pervan
2015/0075104 A1 3/2015 Engstrm
2015/0089896 A2 4/2015 Pervan et al.
2015/0113908 A1 4/2015 Ramachandra et al.
2015/0121796 A1 5/2015 Pervan
2015/0152644 A1 6/2015 Boo
2015/0167318 A1 6/2015 Pervan
2015/0176289 A1 6/2015 Hannig
2015/0176619 A1 6/2015 Baker
2015/0211239 A1 7/2015 Pervan
2015/0233125 A1 8/2015 Pervan et al.
2015/0267419 A1 9/2015 Darko
2015/0300029 A1 10/2015 Pervan
2015/0330088 A1 11/2015 Derelov
2015/0337537 A1 11/2015 Boo
2015/0337542 A1 11/2015 Cappelle et al.
2015/0368910 A1 12/2015 Kell
2016/0032596 A1 2/2016 Nygren et al.
2016/0060879 A1 3/2016 Pervan
2016/0069086 A1 3/2016 Hllenkremer et al.
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0160502 A1 6/2016 Brousseau et al.
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0237695 A1 8/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0289984 A1 10/2016 Wagner
2016/0326751 A1 11/2016 Pervan
2016/0340913 A1 11/2016 Derelov
2017/0030088 A1 2/2017 Simoens
2017/0037641 A1 2/2017 Nygren et al.
2017/0067261 A1 3/2017 Hannig et al.
2017/0081860 A1 3/2017 Boo
2017/0089379 A1 3/2017 Pervan
2017/0254096 A1 9/2017 Pervan
2017/0321433 A1 11/2017 Pervan et al.
2017/0328072 A1 11/2017 Hannig
2017/0362834 A1 12/2017 Pervan et al.
2018/0001509 A1 1/2018 Myllykangas et al.
2018/0001510 A1 1/2018 Fransson
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan
2018/0119431 A1 5/2018 Pervan et al.
2018/0155934 A1 6/2018 D'Hondt et al.
2018/0178406 A1 6/2018 Fransson et al.
2018/0313094 A1 11/2018 Pervan
2018/0362138 A1 12/2018 Gross et al.
2019/0024387 A1 1/2019 Pervan
2019/0048592 A1 2/2019 Boo
2019/0048596 A1 2/2019 Pervan
2019/0063076 A1 2/2019 Boo et al.
2019/0071879 A1 3/2019 Thiers et al.
2019/0093370 A1 3/2019 Pervan et al.
2019/0093371 A1 3/2019 Pervan
2019/0119928 A1 4/2019 Pervan et al.
2019/0127989 A1 5/2019 Kell
2019/0127990 A1 5/2019 Pervan et al.
2019/0169859 A1 6/2019 Pervan et al.
2019/0232473 A1 8/2019 Fransson et al.
2019/0271165 A1 9/2019 Boo
2019/0376298 A1 12/2019 Pervan et al.
2019/0394314 A1 12/2019 Pervan et al.
2020/0087927 A1 3/2020 Pervan
2020/0102756 A1 4/2020 Pervan
2020/0109569 A1 4/2020 Pervan
2020/0149289 A1 5/2020 Pervan
2020/0173175 A1 6/2020 Pervan
2020/0224430 A1 7/2020 Ylikangas et al.
2020/0263437 A1 8/2020 Pervan
2020/0284045 A1 9/2020 Kell
2020/0318667 A1 10/2020 Peter
2020/0354969 A1 11/2020 Pervan et al.
2020/0370304 A1 11/2020 Cappelle
2020/0412852 A9 12/2020 Pervan et al.
2021/0016465 A1 1/2021 Fransson
2021/0047840 A1 2/2021 Pervan
2021/0047841 A1 2/2021 Pervan et al.
2021/0071428 A1 3/2021 Pervan
2021/0087831 A1 3/2021 Nilsson et al.
2021/0087832 A1 3/2021 Boo
2021/0087833 A1 3/2021 Ylikangas et al.
2021/0087834 A1 3/2021 Ylikangas et al.
2021/0348396 A1 11/2021 Pervan et al.

(56) References Cited

U.S. PATENT DOCUMENTS

| | | | |
|---|---|---|---|
| 2021/0381255 | A1 | 12/2021 | Ylikangas et al. |
| 2022/0025657 | A1 | 1/2022 | Pervan |
| 2022/0025658 | A1 | 1/2022 | Kell |
| 2022/0143718 | A1 | 5/2022 | Pervan et al. |

FOREIGN PATENT DOCUMENTS

| | | | |
|---|---|---|---|
| CN | 101484651 | A | 7/2009 |
| CN | 100547206 | C | 10/2009 |
| CN | 101617092 | A | 12/2009 |
| CN | 101622409 | A | 1/2010 |
| CN | 201588375 | U | 9/2010 |
| CN | 101868583 | A | 10/2010 |
| CN | 101932780 | A | 12/2010 |
| CN | 102151404 | A | 8/2011 |
| CN | 102155083 | A | 8/2011 |
| CN | 102362038 | A | 2/2012 |
| CN | 102713105 | A | 10/2012 |
| DE | 0138992 | C | 2/1903 |
| DE | 2159042 | A1 | 6/1973 |
| DE | 2505489 | A1 | 8/1976 |
| DE | 3343601 | A1 | 6/1985 |
| DE | 3345601 | A1 | 6/1985 |
| DE | 3932960 | A1 | 4/1991 |
| DE | 3932980 | A1 | 11/1991 |
| DE | 4215273 | A1 | 11/1993 |
| DE | 4242530 | A1 | 6/1994 |
| DE | 19601322 | A1 | 5/1997 |
| DE | 19601332 | A1 | 7/1997 |
| DE | 29922649 | U1 | 3/2000 |
| DE | 20001788 | U1 | 6/2000 |
| DE | 20002744 | U1 | 8/2000 |
| DE | 19940837 | A1 | 11/2000 |
| DE | 19958225 | A1 | 6/2001 |
| DE | 20205774 | U1 | 8/2002 |
| DE | 0142293 | C | 7/2003 |
| DE | 20320799 | U1 | 4/2005 |
| DE | 102004055951 | A1 | 7/2005 |
| DE | 102004001363 | A1 | 8/2005 |
| DE | 102005002297 | A1 | 8/2005 |
| DE | 102004054368 | A1 | 5/2006 |
| DE | 102005024366 | A1 | 11/2006 |
| DE | 102006024184 | A1 | 11/2007 |
| DE | 102006037614 | B3 | 12/2007 |
| DE | 102006057491 | A1 | 6/2008 |
| DE | 102007018309 | A1 | 8/2008 |
| DE | 102007016533 | A1 | 10/2008 |
| DE | 102007016553 | A1 | 10/2008 |
| DE | 102007032885 | A1 | 1/2009 |
| DE | 102007035646 | A1 | 1/2009 |
| DE | 102007035648 | A1 | 1/2009 |
| DE | 102007049792 | A1 | 2/2009 |
| DE | 102009048050 | B3 | 1/2011 |
| DE | 102009041297 | A1 | 3/2011 |
| DE | 102009046050 | A1 | 4/2011 |
| EP | 0013852 | A1 | 8/1980 |
| EP | 0871156 | A2 | 10/1998 |
| EP | 0974713 | A1 | 1/2000 |
| EP | 1120515 | A1 | 8/2001 |
| EP | 1120516 | A1 | 8/2001 |
| EP | 1146182 | A2 | 10/2001 |
| EP | 1251219 | A1 | 10/2002 |
| EP | 1279778 | A2 | 1/2003 |
| EP | 1350904 | A2 | 10/2003 |
| EP | 1396593 | A2 | 3/2004 |
| EP | 1420125 | A2 | 5/2004 |
| EP | 1437457 | A2 | 7/2004 |
| EP | 1640530 | A2 | 3/2006 |
| EP | 1650375 | A1 | 4/2006 |
| EP | 1980683 | A2 | 10/2008 |
| EP | 2000610 | A1 | 12/2008 |
| EP | 2017403 | A2 | 1/2009 |
| EP | 2034106 | A1 | 3/2009 |
| EP | 2063045 | A2 | 5/2009 |
| EP | 2078801 | A1 | 7/2009 |
| EP | 2236694 | A1 | 10/2010 |
| EP | 2270291 | A1 | 1/2011 |
| EP | 2278091 | A2 | 1/2011 |
| EP | 2333195 | A1 | 6/2011 |
| EP | 2388394 | A2 | 11/2011 |
| EP | 2388409 | A2 | 11/2011 |
| EP | 2390437 | A2 | 11/2011 |
| EP | 2395179 | A2 | 12/2011 |
| EP | 2570564 | A2 | 3/2013 |
| EP | 2604771 | A1 | 6/2013 |
| EP | 2734684 | A1 | 5/2014 |
| FR | 1138595 | A | 6/1957 |
| FR | 2256807 | A1 | 8/1975 |
| FR | 2810060 | A1 | 12/2001 |
| GB | 0240629 | | 10/1925 |
| GB | 0376352 | A | 7/1932 |
| GB | 1171337 | A | 11/1969 |
| GB | 2051916 | A | 1/1981 |
| JP | 03-110258 | A | 5/1991 |
| JP | 05-018028 | A | 1/1993 |
| JP | 06-146553 | A | 5/1994 |
| JP | 06-286017 | A | 10/1994 |
| JP | 06-288017 | A | 10/1994 |
| JP | 06-306961 | A | 11/1994 |
| JP | 06-322848 | A | 11/1994 |
| JP | 07-300979 | A | 11/1995 |
| JP | 2900115 | B2 | 6/1999 |
| JP | 2002-047782 | A | 2/2002 |
| JP | 2008-518130 | A | 5/2008 |
| KR | 10-1206400 | B1 | 11/2012 |
| SE | 526688 | C2 | 10/2005 |
| SE | 529076 | C2 | 4/2007 |
| WO | 94/26999 | A1 | 11/1994 |
| WO | 96/23942 | A1 | 8/1996 |
| WO | 96/27721 | A1 | 9/1996 |
| WO | 97/47834 | A1 | 12/1997 |
| WO | 98/21428 | A1 | 5/1998 |
| WO | 98/22677 | A1 | 5/1998 |
| WO | 98/56142 | A2 | 12/1998 |
| WO | 98/58142 | A1 | 12/1998 |
| WO | 99/66151 | A1 | 12/1999 |
| WO | 99/66152 | A1 | 12/1999 |
| WO | 99/66181 | A1 | 12/1999 |
| WO | 00/20705 | A1 | 4/2000 |
| WO | 00/20706 | A1 | 4/2000 |
| WO | 00/43281 | A2 | 7/2000 |
| WO | 00/47641 | A1 | 8/2000 |
| WO | 00/47841 | A1 | 8/2000 |
| WO | 00/55067 | A1 | 9/2000 |
| WO | 01/02669 | A1 | 1/2001 |
| WO | 01/02670 | A1 | 1/2001 |
| WO | 01/02671 | A1 | 1/2001 |
| WO | 01/02672 | A1 | 1/2001 |
| WO | 01/07729 | A1 | 2/2001 |
| WO | 01/38557 | A1 | 5/2001 |
| WO | 01/38657 | A1 | 5/2001 |
| WO | 01/44669 | A2 | 6/2001 |
| WO | 01/46331 | A2 | 6/2001 |
| WO | 01/48331 | A1 | 7/2001 |
| WO | 01/48332 | A1 | 7/2001 |
| WO | 01/51732 | A1 | 7/2001 |
| WO | 01/51733 | A1 | 7/2001 |
| WO | 01/66877 | A1 | 9/2001 |
| WO | 01/75247 | A1 | 10/2001 |
| WO | 01/77461 | A1 | 10/2001 |
| WO | 01/94721 | A1 | 12/2001 |
| WO | 01/98604 | A1 | 12/2001 |
| WO | 02/48127 | A2 | 6/2002 |
| WO | 02/55610 | A1 | 7/2002 |
| WO | 02/55809 | A1 | 7/2002 |
| WO | 02/55810 | A1 | 7/2002 |
| WO | 02/81843 | A1 | 10/2002 |
| WO | 2002/103135 | A1 | 12/2002 |
| WO | 03/12224 | A1 | 2/2003 |
| WO | 03/16654 | A1 | 2/2003 |
| WO | 03/25307 | A1 | 3/2003 |
| WO | 03/38210 | A1 | 5/2003 |
| WO | 03/44303 | A1 | 5/2003 |
| WO | 03/67497 | A1 | 8/2003 |

(56) References Cited

FOREIGN PATENT DOCUMENTS

| | | | |
|---|---|---|---|
| WO | 03/69094 | A1 | 8/2003 |
| WO | 03/74814 | A1 | 9/2003 |
| WO | 03/83234 | A1 | 10/2003 |
| WO | 03/87497 | A1 | 10/2003 |
| WO | 03/89736 | A1 | 10/2003 |
| WO | 2004/003314 | A1 | 1/2004 |
| WO | 2004/016877 | A1 | 2/2004 |
| WO | 2004/020764 | A1 | 3/2004 |
| WO | 2004/048716 | A1 | 6/2004 |
| WO | 2004/050780 | A2 | 6/2004 |
| WO | 2004/079128 | A1 | 9/2004 |
| WO | 2004/079130 | A1 | 9/2004 |
| WO | 2004/083557 | A1 | 9/2004 |
| WO | 2004/085765 | A1 | 10/2004 |
| WO | 2005/003488 | A1 | 1/2005 |
| WO | 2005/003489 | A1 | 1/2005 |
| WO | 2005/054599 | A1 | 6/2005 |
| WO | 2006/043893 | A1 | 4/2006 |
| WO | 2006/050928 | A1 | 5/2006 |
| WO | 2006/104436 | A1 | 10/2006 |
| WO | 2006/123988 | A1 | 11/2006 |
| WO | 2006/125646 | A1 | 11/2006 |
| WO | 2007/015669 | A2 | 2/2007 |
| WO | 2007/019957 | A1 | 2/2007 |
| WO | 2007/079845 | A1 | 7/2007 |
| WO | 2007/089186 | A1 | 8/2007 |
| WO | 2007/118352 | A1 | 10/2007 |
| WO | 2007/142589 | A1 | 12/2007 |
| WO | 2008/004960 | A2 | 1/2008 |
| WO | 2008/017281 | A1 | 2/2008 |
| WO | 2008/017301 | A2 | 2/2008 |
| WO | 2008/060232 | A1 | 5/2008 |
| WO | 2007/141605 | A3 | 6/2008 |
| WO | 2008/068245 | A1 | 6/2008 |
| WO | 2008/116623 | A1 | 10/2008 |
| WO | 2009/013590 | A2 | 1/2009 |
| WO | 2009/066153 | A2 | 5/2009 |
| WO | 2009/116926 | A1 | 9/2009 |
| WO | 2010/006684 | A2 | 1/2010 |
| WO | 2010/028621 | A1 | 3/2010 |
| WO | 2010/070472 | A2 | 6/2010 |
| WO | 2010/070605 | A2 | 6/2010 |
| WO | 2010/082171 | A2 | 7/2010 |
| WO | 2010/087752 | A1 | 8/2010 |
| WO | 2010/105732 | A1 | 9/2010 |
| WO | 2010/108980 | A1 | 9/2010 |
| WO | 2010/136171 | A1 | 12/2010 |
| WO | 2011/001326 | A2 | 1/2011 |
| WO | 2011/012104 | A2 | 2/2011 |
| WO | 2011/012105 | A1 | 2/2011 |
| WO | 2011/032540 | A2 | 3/2011 |
| WO | 2011/038709 | A1 | 4/2011 |
| WO | 2011/085788 | A1 | 7/2011 |
| WO | 2011/108812 | A2 | 9/2011 |
| WO | 2011/127981 | A1 | 10/2011 |
| WO | 2011/151758 | A2 | 12/2011 |
| WO | 2012/059093 | A2 | 5/2012 |
| WO | 2013/012386 | A1 | 1/2013 |
| WO | 2013/017574 | A1 | 2/2013 |
| WO | 2013/017575 | A1 | 2/2013 |
| WO | 2013/025163 | A1 | 2/2013 |
| WO | 2013/025164 | A1 | 2/2013 |
| WO | 2013/026164 | A1 | 2/2013 |
| WO | 2013/032391 | A1 | 3/2013 |
| WO | 2013/083629 | A1 | 6/2013 |
| WO | 2013/087190 | A1 | 6/2013 |
| WO | 2013/151493 | A1 | 10/2013 |
| WO | 2014/209213 | A1 | 12/2014 |
| WO | 2015/105449 | A1 | 7/2015 |

OTHER PUBLICATIONS

Boo Christian, U.S. Appl. No. 15/365,546, entitled "Building Panel With a Mechanical Locking System," filed Nov. 30, 2016.

Decision to grant received for European Patent Application No. 14817686, mailed on Sep. 5, 2019, 2 pages.

Decision to grant received for European Patent Application No. 19200326, mailed on Nov. 17, 2022, 2 pages.

Derelov, Peter, U.S. Appl. No. 14/709,913 entitled "Building Panel with a Mechanical Locking System," filed May 12, 2015.

Derelov, Peter, U.S. Appl. No. 15/229,575 entitled "Building Panel with a Mechanical Locking System," filed Aug. 5, 2016.

Engstrand, "VA-038 Mechanical Locking of Floor Panels With Vertical Folding", Valinge InnovBiion AB, Technical Disclosure, IP com No. IPCOM000179246D, IP.com Prior Art Database, 59 pages.

Engstrand, Ola (Contact)/Valinge Innovation AB, Technical Disclosure entitled "VA055 Mechanical locking system for floor panels," IP com No. IPCOM000206454D, Apr. 27, 2011, IP.com Prior Art Database, 25 pages.

Engstrand, Ola (Contact)/Valinge Innovation AB, Technical Disclosure entitled "VA058 Rocker Tongue," IP com No. IPCOM000203832D, Feb. 4, 2011, IP.com Prior Art Database, 22 pages.

Engstrand, Ola (Owner)/Valinge Innovation AB, Technical Disclosure entitled "VA043b PCT Mechanical Locking of Floor Panels," IP com No. IPCOM000189420D, Nov. 9, 2009, IP.com Prior Art Database, 62 pages.

Engstrand, Ola , "VA043 5G Linear Slide Tongue" , Valinge Innovation AB, Technical Disclosure, IP com No. IPCOM000179015D, IP.com Prior Art Database, , 126 pages.

European Search Report and Search Opinion received for European Application No. 19200326, mailed on Jan. 24, 2020, 9 pages.

European Search Report and Search Opinion received for European Application No. 22212537.9, mailed on Mar. 15, 2023, 11 pages.

Intention to grant received for European Patent Application No. 14817686, mailed on Apr. 18, 2019, 6 pages.

Intention to grant received for European Patent Application No. 19200326, mailed on Jul. 7, 2022, 6 pages.

International Preliminary Report on Patentability received for PCT Patent Application No. PCT/SE2014/050792, mailed on Jan. 7, 2016, 10 pages.

International Search Report and Written Opinion received for PCT Patent Application No. PCT/SE2014/050792, mailed on Oct. 23, 2014, 15 pages.

Laminate Flooring Tips (http://flooring.lifetips.com/cat/61734/laminate-flooring-tips/index.html-). Copyright 2000. 12 pages.

Notice of Allowance received for Chinese Patent Application No. 201480034826.8, mailed on Mar. 13, 2019, 3 pages (2 pages of English Translation and 1 page of Original Document).

Notice of Allowance received for Chinese Patent Application No. 201910383622.X, mailed on Jul. 12, 2021, 3 pages (2 pages of English Translation and 1 page of Original Document).

Notice of Allowance received for Korean Patent Application No. 10-2016-7001077, mailed on Apr. 29, 2021, 4 pages (2 pages of English Translation and 2 pages of Original Document).

Office Action received for Chinese Patent Application No. 201480034826.8, mailed on Jan. 24, 2017, 16 pages (8 pages of English Translation and 8 pages of Original Document).

Office Action received for Chinese Patent Application No. 201480034826.8, mailed on Nov. 7, 2018, 7 pages (4 pages of English Translation and 3 pages of Original Document).

Office Action received for Chinese Patent Application No. 201910383622.X, mailed on Jul. 28, 2020, 14 pages (7 pages of English Translation and 7 pages of Original Document).

Office Action received for Chinese Patent Application No. 201910383622.X, mailed on Mar. 11, 2021, 14 pages (7 pages of English Translation and 7 pages of Original Document).

Office Action received for European Patent Application No. 14817686.0, mailed on Jul. 27, 2018, 6 pages.

Office Action received for Japanese Patent Application No. 2016-523699, mailed on Feb. 23, 2018, 12 pages (6 pages of English Translation and 6 pages of Original Document).

Office Action received for Korean Patent Application No. 10-2016-7001077, mailed on Oct. 29, 2020, 11 pages (6 pages of English Translation and 5 pages of Original Document).

Pervan, Darko (Author), Technical Disclosure entitled "VA069 Combi Tongue," IP com No. IPCOM000210866D, Sep. 13, 2011, IP.com Prior Art Database, 41 pages.

(56) References Cited

OTHER PUBLICATIONS

Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
Pervan, Darko (Author)/Valinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Valinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko , "Mechanical Locking System for Panels awl Method of Installing Same" , U.S. Appl. No. 15/726,853.
Pervan, Darko , "VA068 Press Lock VFT" , Vailage Flooring Technology, Technical Disclosure, IP com No. IPCOM000208-854D , 25 pages.
Pervan, Darko, et al., U.S. Appl. No. 14/294,230, entitled "Mechanical Locking System for Floor Panels," filed Jun. 3, 2014.
Pervan, Darko, et al., U.S. Appl. No. 14/463,972, entitled "Mechanical Locking of Floor Panels with a Flexible Bristle Tongue," filed Aug. 20, 2014.
Pervan, Darko, et al., U.S. Appl. No. 14/483,352, entitled "Mechanical Locking System for Floor Panels," filed Sep. 11, 2014.
Pervan, Darko, et al., U.S. Appl. No. 14/701,959 entitled "Mechanical Locking system for Floor Panels," filed May 1, 2015.
Pervan, Darko, et al., U.S. Appl. No. 14/962,291, entitled "Mechanical Locking System for Floor Panels," filed Dec. 8, 2015.
Pervan, Darko, et al., U.S. Appl. No. 15/048,252, entitled "Mechanical Locking System for Floor Panels," filed Feb. 19, 2016.
Pervan, Darko, et al., U.S. Appl. No. 15/172,926, entitled "Mechanical Locking of Floor Panels with a Flexible Bristle Tongue," filed Jun. 3, 2016.
Pervan, Darko, et al., U.S. Appl. No. 15/175,768, entitled "Mechanical Locking System for Floor Panels," filed Jun. 7, 2016.
Pervan, Darko, et al., U.S. Appl. No. 15/217,023, entitled "Mechanical Locking System for Floor Panels," filed Jul. 22, 2016.
Pervan, Darko, et al., U.S. Appl. No. 15/855,389 entitled "Mechanical Locking System for Floor Panels," filed Dec. 27, 2017.
Pervan, Darko, et al., U.S. Appl. No. 15/896,571 entitled "Mechanical Locking of Floor Panels with a Flexible Tongue," filed Feb. 14, 2018.
Pervan, Darko, et al., U.S. Appl. No. 16/224,951 entitled "Mechanical Locking System for Floor Panels," filed Dec. 19, 2018.
Pervan, Darko, et al., U.S. Appl. No. 16/269,805 entitled "Mechanical Locking System for Floor Panels," filed Feb. 7, 2019.
Pervan, Darko, et al., U.S. Appl. No. 16/269,806 entitled "Mechanical Locking System for Floor Panels," filed Feb. 7, 2019.
Pervan, Darko, et al., U.S. Appl. No. 16/861,686 entitled "Mechanical Locking of Floor Panels with a Flexible Bristle Tongue," filed Apr. 29, 2020.
Pervan, Darko, et al., U.S. Appl. No. 17/206,702 entitled "Mechanical Locking of Floor Panels with a Flexible Tongue," filed Mar. 19, 2021.
Pervan, Darko, U.S. Appl. No. 14/294,623, entitled "Mechanical Locking of Floor Panels with Vertical Folding," filed Jun. 3, 2014.
Pervan, Darko, U.S. Appl. No. 14/538,223, entitled "Mechanical Locking System for Floor Panels," filed Nov. 11, 2014.
Pervan, Darko, U.S. Appl. No. 14/597,578 entitled "Mechanical Locking of Floor Panels with a Glued Tongue," filed Jan. 15, 2015.
Pervan, Darko, U.S. Appl. No. 14/646,567 entitled "Mechanical Locking System for Floor Panels," filed May 21, 2015.
Pervan, Darko, U.S. Appl. No. 14/683,340 entitled "Mechanical Locking System for Floor Panels," filed Apr. 10, 2015.
Pervan, Darko, U.S. Appl. No. 14/730,691 entitled "Mechanical Locking System for Panels and Method for Installing Same," filed Jun. 4, 2015.
Pervan, Darko, U.S. Appl. No. 14/938,612, entitled "Mechanical Locking System for Floor Panels," filed Nov. 11, 2015.
Pervan, Darko, U.S. Appl. No. 14/951,976, entitled "Mechanical Locking System for Floor Panels," filed Nov. 25, 2015.
Pervan, Darko, U.S. Appl. No. 15/148,820, entitled "Mechanical Locking System for Panels and Method of Installing Same," filed May 6, 2016.
Pervan, Darko, U.S. Appl. No. 15/160,311, entitled "Mechanical Locking System for Floor Panels," filed May 20, 2016.
Pervan, Darko, U.S. Appl. No. 15/261,071, entitled "Mechanical Locking System for Floor Panels," filed Sep. 9, 2016.
Pervan, Darko, U.S. Appl. No. 15/603,913, entitled "Mechanical Locking System for Floor Panels," filed May 24, 2017.
Pervan, Darko, U.S. Appl. No. 15/813,855 entitled "Mechanical Locking of Floor Panels with a Glued Tongue," filed Nov. 15, 2017.
Pervan, Darko, U.S. Appl. No. 16/143,610 entitled "Mechanical Locking System for Panels and Method of Installing Same," filed Sep. 27, 2018.
Pervan, Darko, U.S. Appl. No. 16/163,088 entitled "Mechanical Locking System for Floor Panels," filed Oct. 17, 2018.
Pervan, Darko, U.S. Appl. No. 16/439,827 entitled "Mechanical Locking of Floor Panels With Vertical Folding," filed Jun. 13, 2019.
Pervan, Darko, U.S. Appl. No. 16/581,990 entitled "Mechanical Locking System for Floor Panels," filed Sep. 25, 2019.
Pervan, Darko, U.S. Appl. No. 16/692,104 entitled "Mechanical Locking System for Floor Panels," filed Nov. 22, 2019.
Pervan, Darko, U.S. Appl. No. 16/781,301 entitled "Mechanical Locking of Floor Panels," filed Feb. 4, 2020.
Pervan, Darko, U.S. Appl. No. 16/861,666 entitled "Mechanical Locking System for Panels and Method of Installing Same," filed Apr. 29, 2020.
Pervan, Darko, U.S. Appl. No. 16/908,902 entitled "Mechanical Locking System for Floor Panels," filed Jun. 23, 2020.
Pervan, Darko, U.S. Appl. No. 17/224,290 entitled "Mechanical Locking System for Floor Panels," filed Apr. 7, 2021.
Pervan, Darko, U.S. Appl. No. 17/314,431 entitled "Mechanical Locking of Floor Panels with Vertical Folding," filed May 7, 2021.
Pervan, Darko., U.S. Appl. No. 14/503,780 entitled "Mechanical Locking of Floor Panels," filed Oct. 1, 2014.
Supplementary European Search Report and Search Opinion received for European Application No. 14817686.0, mailed on Jan. 25, 2017, 13 pages.
Vaiinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Ylikangas, Roger, et al., U.S. Appl. No. 16/713,373 entitled "Unlocking System for Panels," filed Dec. 13, 2019.
U.S. Appl. No. 17/697,334, Fredrik Boo, filed Mar. 17, 2022.
U.S. Appl. No. 18/069,320, Lucas Larsson, filed Dec. 21, 2022.
U.S. Appl. No. 18/313,110, Darko Pervan, filed May 5, 2023.
U.S. Appl. No. 18/242,312, Roger Ylikangas, filed Sep. 5, 2023.
U.S. Appl. No. 18/370,443, Fredrik Boo, filed Sep. 20, 2023.
U.S. Appl. No. 18/370,454, Anders Nilsson, filed Sep. 20, 2023.
U.S. Appl. No. 19/014,541, Fredrik Boo, filed Jan. 9, 2025.
U.S. Appl. No. 18/963,840, Anders Nilsson, filed Nov. 29, 2024.

FIG. 1A --PRIOR ART--
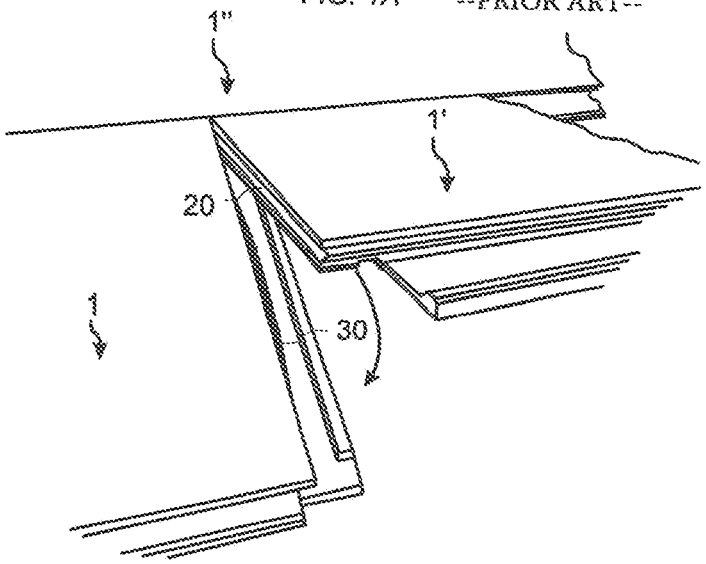
FIG. 1B --PRIOR ART--
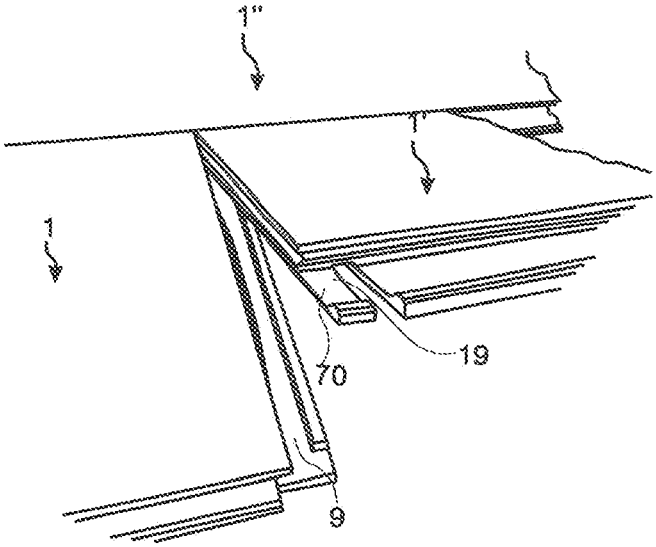

FIG. 2A --PRIOR ART--
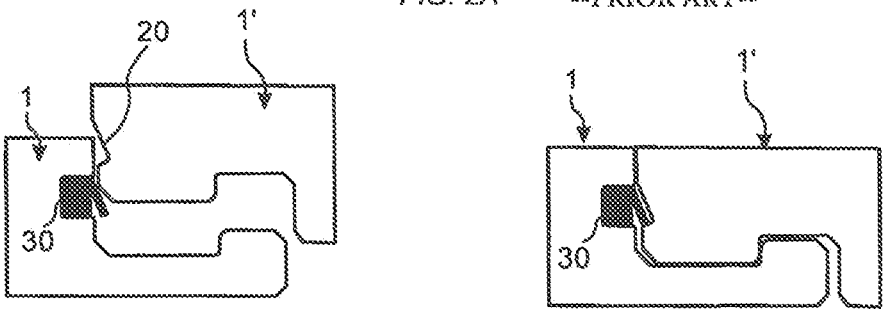
FIG. 2B --PRIOR ART--
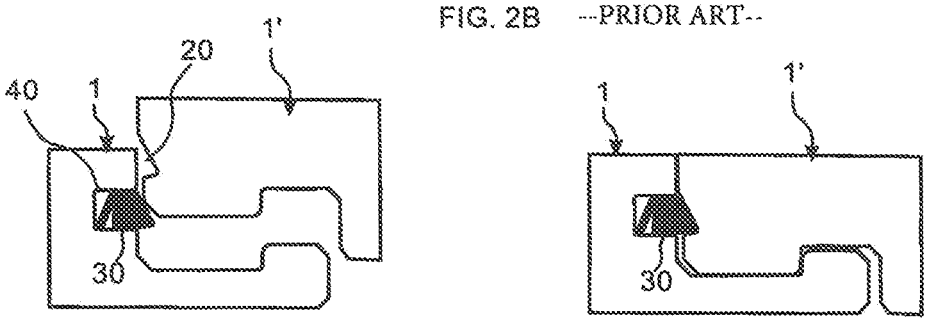
FIG. 2C --PRIOR ART--
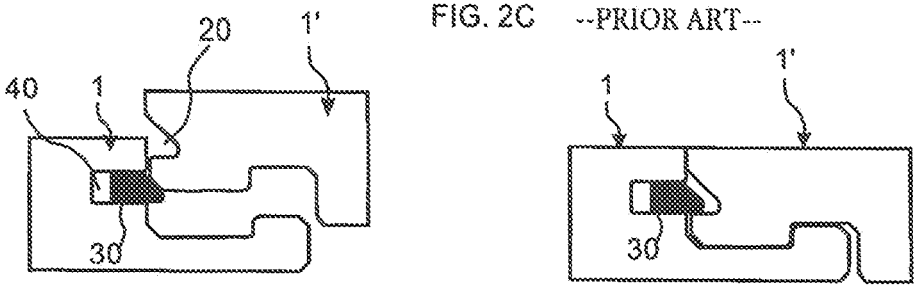

FIG. 3A --PRIOR ART--
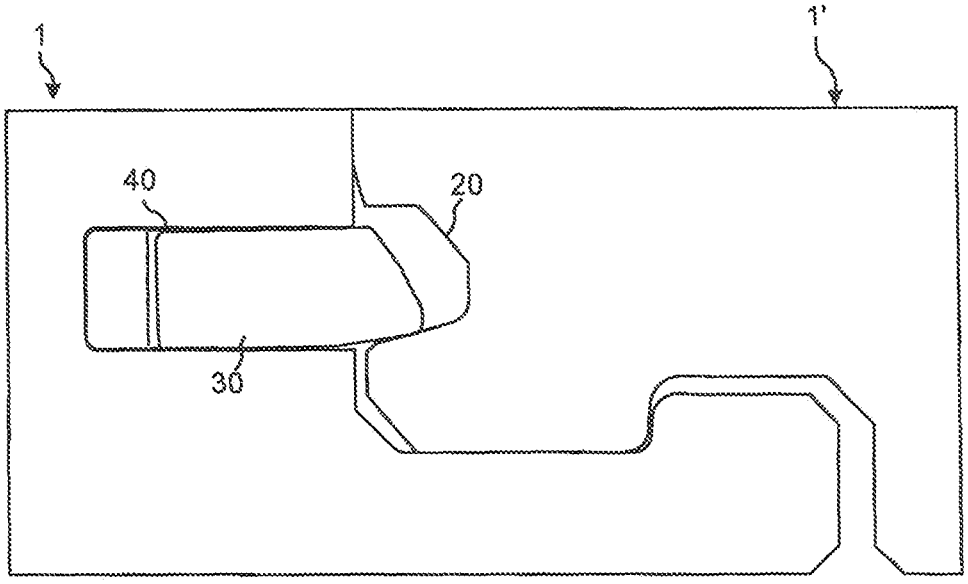
FIG. 3B --PRIOR ART--
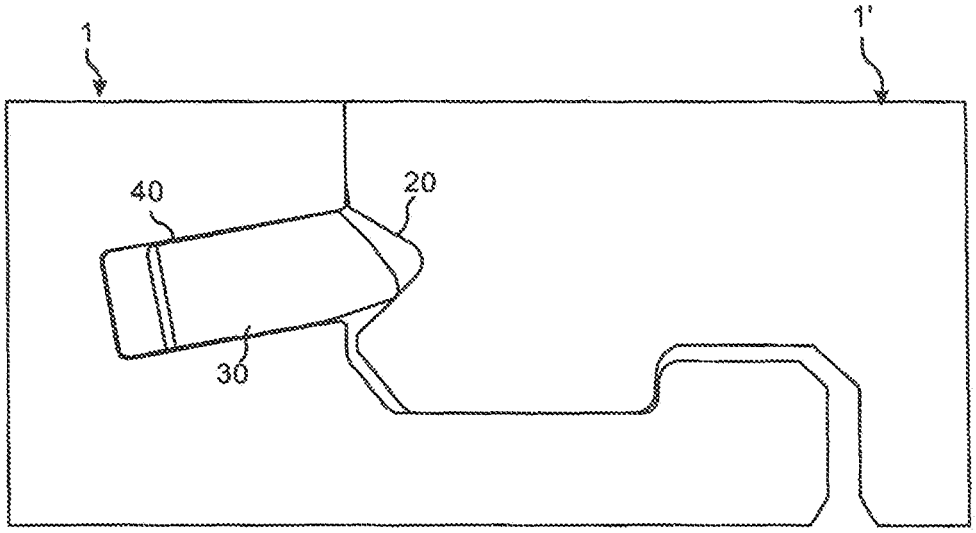

--PRIOR ART--

--PRIOR ART--

BUILDING PANEL WITH A MECHANICAL LOCKING SYSTEM

CROSS REFERENCE TO RELATED APPLICATIONS

The present application is a continuation of U.S. application Ser. No. 17/349,345, filed on Jun. 16, 2021, which is a continuation of U.S. application Ser. No. 16/419,660, filed on May 22, 2019, now U.S. Pat. No. 11,066,835, which is a continuation of U.S. patent Ser. No. 15/365,546, now U.S. Pat. No. 10,352,049, which is a divisional of U.S. application Ser. No. 14/315,879, filed on Jun. 26, 2014, now U.S. Pat. No. 10,017,948, which claims the benefit of Swedish Application No. 1350783-5, filed on Jun. 27, 2013, and of Swedish Application No. 1351323-9, filed on Nov. 8, 2013. The entire contents of each of U.S. application Ser. No. 17/349,345, U.S. application Ser. No. 16/419,660, U.S. application Ser. No. 15/365,546, U.S. application Ser. No. 14/315,879, Swedish Application No. 1350783-5, and Swedish Application No. 1351323-9 are hereby incorporated herein by reference in their entirety.

TECHNICAL FIELD

The disclosure relates to panels, such as building panels, floorboard, wall panels, ceiling panels, furniture components or the like, which are provided with a mechanical locking system.

TECHNICAL BACKGROUND

Building panels provided with a mechanical locking system comprising a displaceable and resilient tongue cooperating with a tongue groove for vertical locking is known and disclosed in, e.g., WO 2006/043893 and WO 2007/015669, The tongue is a separate part and is made of, e.g., plastic and inserted in a displacement groove at an edge of a panel. The tongue is pushed into the displacement groove during a vertical assembling of the panels and springs back into the tongue groove of an adjacent panel when the panels have reached a locked position.

Also known is a locking system for panels comprising a tongue, which is displaceable along the edge of a panel, see e.g. WO 2009/116926, and cooperates with a tongue groove for vertical locking. The tongue is a separate part and is provided with several protrusions, which initially match recesses of the tongue groove. The panels may be assembled by a vertical movement and the tongue is displaced to a position in which the protrusions no longer match the recesses in order to obtain the vertical locking.

Further known is a locking system comprising a tongue provided with, e.g., a wedge element. Two adjacent panel edges are locked by displacing the tongue along the adjacent edges, see, e.g., WO 2008/004960.

Although the description relates to floor panel, the description of techniques and problems thereof is applicable also for other applications, such as panels for other purposes, for example, wall panels, ceiling panels, furniture etc.

A drawback with the known systems is that a locking system comprising a displaceable tongue requires a rather thick panel to ensure that the locking system meets the strength requirement.

The above description of various known aspects is the applicant's characterization of such, and is not an admission that any of the above description is considered as prior art.

SUMMARY

It is an object of certain embodiments of the disclosure to provide an improvement over the above described techniques and known art. Particularly the strength of the known locking system is improved by embodiments of the disclosure.

A further object of embodiments of the disclosure is to provide thinner panels with a locking system comprising a displaceable tongue.

At least some of these and other objects and advantages that will be apparent from the description have been achieved by a first aspect of the disclosure that comprises a set of essentially identical panels provided with a mechanical locking system comprising a displaceable tongue, which is arranged in a displacement groove at a first edge of a first panel and a first tongue groove, at a second edge of an adjacent second panel. The displaceable tongue is configured to cooperate with the first tongue groove for locking in a vertical direction of the first and the second edge. The displacement groove is provided with a first opening and the first tongue groove is provided with a second opening wherein a height of the first opening is greater than a height of the second opening. At least a part of the displaceable tongue is preferably configured to be pushed into the displacement groove during assembling of the first and the second panel and spring back to a position in which an outer part of the displaceable tongue cooperate with the first tongue groove for the locking in the vertical direction.

The height of the second opening may be in the range of about 20% to about 75% of the height of the first opening, preferably in the range of about 20% to about 50% of the height of the first opening.

The first opening and the second opening are preferably horizontally open, and a vertical height of the second groove is preferably greater than a vertical height the first opening.

A maximum height of the displacement groove may be greater than a maximum height of the first tongue groove. The maximum height of the first tongue groove may be in the range of about 20% to about 75% of the maximum height of the displacement groove, preferably in the range of about 20% to about 50% of the maximum height of the displacement groove.

An outer part of the displaceable tongue is preferably provided with a recess. The smaller opening of the first tongue groove and the thinner first tongue groove increases the strength of the locking system at the second edge with the first tongue groove. The thicker displacement groove is preferably provided on an edge, i.e., the first edge, with more material available for the displacement groove or a stronger material.

The recess may comprise a first recess surface and a second recess surface, which are arranged at an obtuse angle to each other. The first recess surface of the recess may be a first surface configured to cooperate with the first tongue groove, preferably at a second surface, for locking in the vertical direction. An angle between an upper surface of the displaceable tongue and the first recess surface may be in the range of about 5° to about 15°, preferably in the range of about 7° to about 8°. The recess and the angle may provide the benefit of an increased locking strength, since the first surface and the second surface may be arranged at an angle that requires, in a locked position, an increased force to push the displaceable tongue into the displacement groove.

The displaceable tongue is preferably of a longitudinal shape and an outer longitudinal edge of the displaceable tongue is preferably straight along essentially the whole longitudinal length of the tongue. A bevel may be provided at at least one end of the longitudinal edge, at a short edge of the displaceable tongue, to facilitate assembling of the first and the second panel by an angling movement.

The recess preferably extends along essentially the whole longitudinal length of the displaceable tongue.

The benefits of embodiments of the disclosure may be more pronounced for thin panels, e.g. thinner than 6 mm. The panels may be in the range of about 3 mm to about 10 mm, preferably in the range of about 4 mm to about 8 mm, and preferably in the range of about 4 mm to about 6 mm.

The mechanical locking system may comprise a first locking strip, at the first or the second edge, provided with a first locking element configured to cooperate for horizontal locking with a first locking groove at the other of the first or second edge.

Since the height of the first opening is greater than the second height of the second opening, the first locking strip is preferably arranged at the first edge and the first locking groove on the second edge. An outer and lower part of the displaceable tongue is preferably provided with the recess.

The panels may be rectangular, and the mechanical locking system may comprise a second locking strip, at a third or fourth edge, provided with a second locking element configured to cooperate for horizontal locking with a locking groove at the other of the third or fourth edge of an adjacent third panel. The third or the fourth edge is preferably provided with a second tongue configured to cooperate for vertical locking with a second tongue groove at the other of the third or fourth edge of an adjacent third panel. Each edge provided with a locking groove is preferably provided with a lower edge surface configured to cooperate with an upper surface of a locking strip at an adjacent panel. The lower edge surface is therefore preferably arranged in the same plane as the upper surface of the locking strip at the adjacent panel.

An upper surface of the first locking strip is preferably provided in a same plane as an upper surface of the second locking strip. The mechanical locking system at the third and fourth edge is normally produced before the mechanical locking system at the first and second edge. If said upper surfaces are in the same plane or essentially in the same plane remainders of the mechanical locking system at the third and fourth edge, at the corner of the panels may be automatically removed. The remainders are generally thin and may later come loose, e.g. during packaging, transportation or assembling.

The mechanical locking system at the third and the fourth edge may be configured to be assembled by an angling motion.

The mechanical locking system at the first and the second edge may be configured to be assembled by a vertical motion.

A second aspect of the disclosure is a set of essentially identical panels provided with a mechanical locking system comprising a displaceable tongue, which is arranged in a displacement groove at a first edge of a first panel and a first tongue groove at a second edge of a second panel. The displaceable tongue is configured to cooperate with the first tongue groove, for locking in a vertical direction of the first and the second edge. The displaceable tongue comprises at least two bendable parts, wherein at least one of the bendable parts is provided with a lower and/or an upper friction connection at a distance from the innermost part in the displacement groove of the bendable part. The distance may make it easier to arrange the displaceable tongue in the displacement groove. At least a part of the displaceable tongue is preferably configured to be pushed into the displacement groove during assembling of the first and the second panel and spring back to a position in which an outer part of the displaceable tongue cooperate with the first tongue groove for the locking in the vertical direction.

The displacement groove may comprise an upper wall, a lower wall and an inner wall extending between the lower and the upper wall. The inner wall is preferably of a rounded shape or may comprise a plane section provided with a round section adjacent to the upper and/or lower wall. The rounded shape and the round section/s increase the strength of the mechanical locking system. The benefits of this embodiment may be important for thin panels, e.g. thinner than 6 mm. The panels may be in the range of about 3 mm to about 10 mm, and preferably in the range of about 4 mm to about 8 mm.

The upper friction connection is preferably configured to cooperate with a plane section of the upper wall. The upper friction connection may comprise a protruding part of the bendable part that extends above remaining parts of the displaceable tongue. An upper surface of the displaceable tongue may be configured to be displaced along the upper wall during assembling of the first and the second panel. A lower surface of the displaceable tongue may be configured to be displaced along the lower wall during assembling of the first and the second panel.

The lower friction connection is preferably configured to cooperate with a plane section of the lower wall. The lower friction connection may comprise a protruding part of the bendable part that extends below remaining parts of the displaceable tongue.

The innermost part of the bendable part may be provided with an upper and/or lower bevel. The upper and/or lower bevel facilitates the insertion of the displaceable tongue into the displacement groove.

The displaceable tongue may be of a longitudinal shape and an outer longitudinal edge of the displaceable tongue is preferably straight along essentially the whole longitudinal length of the displaceable tongue. A bevel may be provided at at least one end of the longitudinal edge, at a short edge of the displaceable tongue, to facilitate assembling of the first and the second panel by an angling movement.

An outer part of the displaceable tongue may be provided with a recess, which preferably extends along essentially the whole longitudinal length of the tongue. A first surface of the recess is preferably configured to cooperate with a second surface of the first tongue groove for locking in the vertical direction.

The mechanical locking system may comprise a first locking strip, at the first or the second edge, provided with a first locking element configured to cooperate with a first locking groove at the other of the first or second edge for locking in a horizontal direction.

A size of the displacement groove at the first edge may be greater than a size of the first tongue groove at the second edge. The first locking strip is preferably arranged at the first edge and the first locking groove on the second edge. An outer and lower part of the displaceable tongue is preferably provided with the recess.

The displacement groove may have a first opening and the first tongue groove may have a second opening, wherein a first height of the first opening is preferably greater than a second height of the second opening.

The mechanical locking system at the first and the second edge may be configured to be assembled by a vertical motion.

A third aspect of the disclosure is a set of essentially identical panels provided with a mechanical locking system comprising a displaceable tongue, which is arranged in a displacement groove at a first edge of a first panel and a first tongue groove at a second edge of a second panel. The displaceable tongue is configured to cooperate with the first tongue groove, for locking in a vertical direction of the first and the second edge. At least a part of the displaceable tongue is preferably configured to be pushed into the displacement groove during assembling of the first and the second panel and spring back to a position in which a part of the displaceable tongue cooperate with the first tongue groove for the locking in the vertical direction. The displaceable tongue comprises a first and a third surface and the first tongue groove comprises a second and fourth surface. A first angle between the second surface and a front face of the second panel is greater than a second angle between the fourth surface and the front face. The first surface of the displaceable tongue is configured to cooperate with the second surface of the tongue groove under a first load on the mechanical locking system. The third surface of the displaceable tongue is configured to cooperate with the fourth surface of the tongue groove under a second load on the mechanical locking system. The first load may correspond to a load under normal conditions and the second load may correspond to an increased load when, for example, a chair, a sofa, or a bookcase is positioned on the first or the second panel. The first angle may have the advantage that a small displacement of the displaceable tongue pushes the first and the second panel together to the desired locked position, in which the front face of the second panel is essentially in the same vertical position as a front face of the first panel. The second angle may have the advantage that the third and the fourth surface are able to carry a greater load and that the displaceable tongue is prevented from being pushed out from the first tongue groove. Another advantage of the second angle is that a height of an opening of the first tongue may be decreased. A decreased height may increase the strength of the mechanical locking system. The first angle may be in the range of about 30° to about 45° and the second angle may be in the range of about 10° to about 25°. The difference between the first angle and the second angle may be in the range of about 10° to about 35°.

The mechanical locking system described under the first and the second aspect may comprise the first, the second, the third and the fourth surface described under the third aspect.

The mechanical locking system at the first and the second edge may be configured to be assembled by a vertical motion.

The panels according to the first, the second or the third aspect may be floorboards, wall panels, ceiling panels, a furniture component, or the like.

A core of the panels according to the first, the second or the third aspect may be a wood-based core, preferably made of MDF, HDF, OSB, WPC, plywood, or particleboard. The core may also be a plastic core comprising thermosetting plastic or thermoplastic e.g. vinyl, PVC, PU or PET. The plastic core may comprise fillers. The thinner first tongue groove may be easier, for a panel with a layered core, such as a core comprising plywood, to arrange at a favorable position in relation to the layers is the core.

The front face of the panels according to the first, the second or the third aspect is preferably provided with a decorative layer and the back face is preferably provided with a balancing layer.

The edge of the panels, according to the first, the second or the third aspect, of which parts of the locking system, such as the first and the second locking strip, the first and the second locking element, the first and the second locking groove and the first and the second tongue groove, may be made, may comprise the core material.

BRIEF DESCRIPTION OF THE DRAWINGS

The disclosure will by way of example be described in more detail with reference to the appended schematic drawings, which show embodiments of the disclosure.

FIGS. 1A-1B show a known locking system with a displaceable tongue.

FIGS. 2A-2C show cross sections of known locking systems with a separate and displaceable tongue.

FIGS. 3A-3B show cross sections of known locking system with a separate and displaceable tongue.

DETAILED DESCRIPTION

Figure 4A:
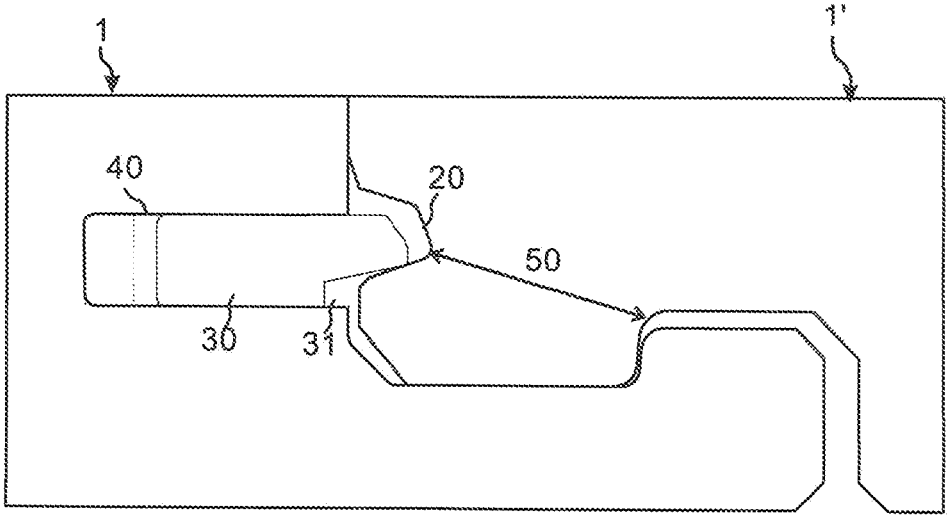
FIGS. 4A-4B show cross sections of panels according to embodiments of the disclosure.
Figure 4B:
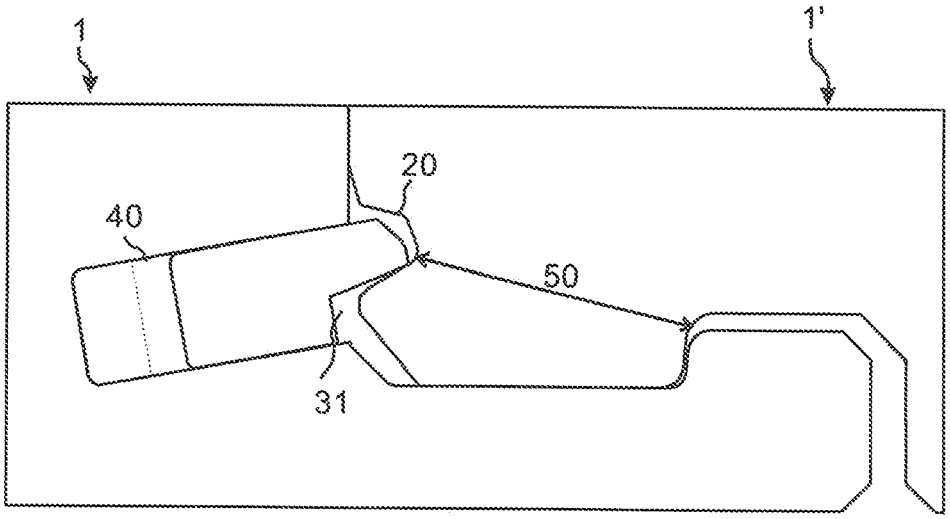

A known mechanical locking system for building panels, which comprises a displaceable tongue 30 at a first edge of a first panel 1 and a first tongue groove 20 at a second edge of a second panel 1', is shown in FIGS. 1A-B. The displaceable tongue is configured to cooperate with the first tongue groove for locking in a vertical direction. The displaceable tongue 30 is a separate part and is made of, e.g., plastic, and inserted in a displacement groove at the first edge of the first panel 1. The tongue is pushed into a displacement groove during a vertical assembling of the first and the second edge of the first and the second panel. The displaceable tongue springs back and into a first tongue groove 20 at the second edge of the second panel 1' when the panels have reached a locked position. A third and a fourth edge of the panels are provided with a locking system, which enables assembling to an adjacent panel 1" by an angling movement, to obtain a simultaneous assembling of the first and the second edges and the third and the fourth edges.

FIGS. 2A-2C and 3A-3B show cross sections of different embodiments of the known displaceable tongue 30 during assembling of a first and a second panel 1, 1'. The second panel 1' with the first tongue groove is displaced in relation to the second panel with the displaceable tongue 30, which is pushed into a displacement groove 40 by an edge of the second panel. The displaceable tongue 30 springs back, and into the first tongue groove 20, when the panels have reached an assembled position, and locks the first and the second panels vertically.

Embodiments of the disclosure are shown in FIGS. 4A-4B, 5A-5B, 6A-6B, 7A-7B, 8A-8D, 9B-9C, 10A-10B, 11A-11C, FIG. 12A-12B and FIG. 13A-13C. A mechanical locking system is formed at a first and a second edge of essentially identical first and second panels 1, 1'. The mechanical locking system is configured for locking the first edge of the first panel to the second edge of the second panel, in a vertical and/or horizontal direction. An embodiment of the mechanical locking system enables assembling of the first and the second panels by a vertical displacement of the second edge of the second panel relative the first edge of the first panel. The mechanical locking system is preferably formed by mechanical cutting, such as milling, drilling and/or sawing, of the edges of the panels and provided with a displaceable tongue 30, preferably of plastic. The displaceable tongue may be bendable and provided with protruding bendable parts, such as the displaceable tongues disclosed in WO2006/043893 and WO2007/015669. The displaceable tongue may also be configured to be locked by a movement along the first and the second edge, such as the displaceable tongues disclosed in WO2009/116926 and WO200/8004960.

Embodiments comprise a displaceable tongue 30 arranged in a displacement groove 40 at the first edge of the first panel 1. The displaceable tongue 30 cooperates with a first tongue groove 20, which is formed at the second edge of a second panel 1', for locking of the first and the second edge in a vertical direction. A first locking strip 6 with a vertically protruding first locking element 8 is formed in the first edge of the first panel. The first locking element 8 cooperates with a first locking groove 14, formed in the second edge of the second panel 1', for locking of the first and the second edge in a horizontal direction. A lower edge surface of the second edge may be arranged in the same plane as a first upper surface of the first locking element. The lower edge surface may be configured to cooperate with the first upper surface for locking the first and the second edge in a vertical direction. FIGS. 4A-4B and FIGS. 5A-5B show that the height 21 of the opening of the first tongue groove 20 is smaller than the height 41 of the displacement groove 40. Preferably, also the maximum height of the first tongue groove 20 is smaller than the maximum height 42 of the displacement groove 40. The tongue groove and the displacement groove may be provided with a guiding bevel or rounding that are not included in the height of the opening or the maximum height of the groove when measuring the heights of the grooves. Such a first tongue groove has the effect that the distance 23 between a lower side of the second panel and the bottom of the first tongue groove may be increased and the distance 50 between the first tongue groove 20 and the locking groove 14 may be increased. The increased distance 50 between the first tongue groove 20 and the locking groove 14 increases the strength of the locking system. In order to further increase the distance and the strength the displacement groove and the displaceable tongue may be angled, as is shown in, e.g., FIG. 4B and FIG. 5A-B. The outer part of the displaceable tongue is preferably provided with a recess 31, so that the outer part may be displaced into the first tongue groove 20.

Figure 5A:
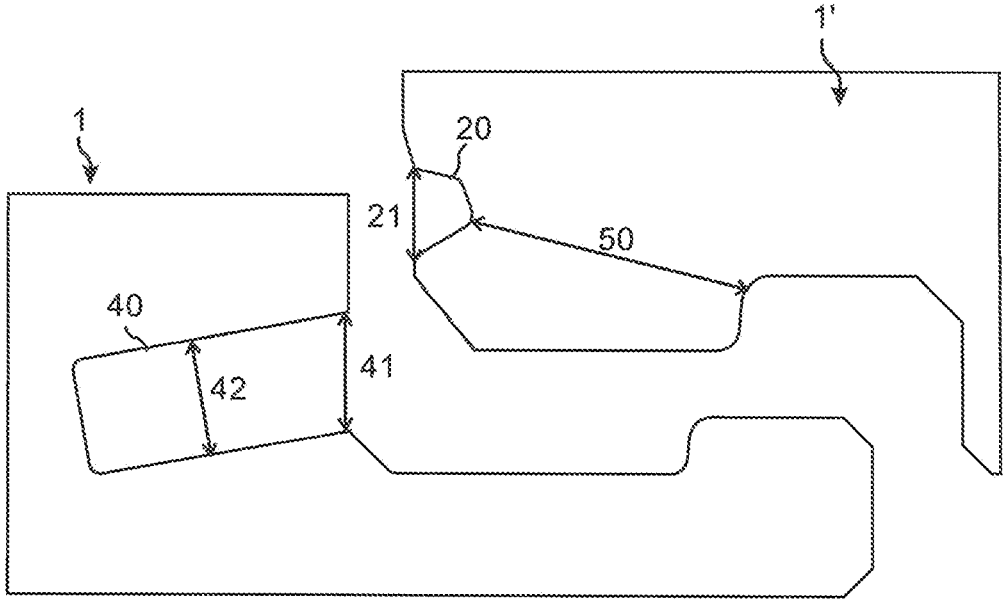
FIGS. 5A-5B show cross sections of panels according to an embodiment of the disclosure.
Figure 5B:
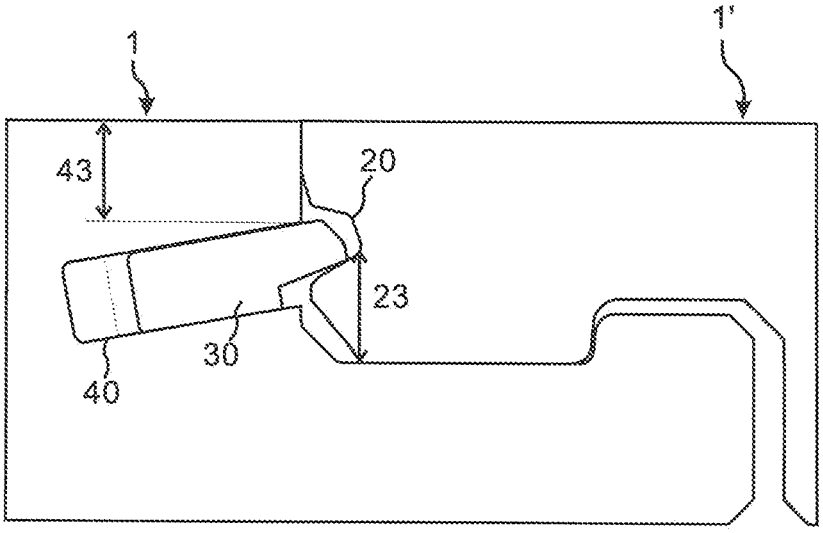

With the smaller first tongue groove 20 the distance 43 between a front face of the first panel and the displacement groove 40 may be increased and/or the thickness of the locking strip 6 may be increased with the same or increased distance 50 between the first tongue groove 20 and the locking groove 14 for the same thickness of the first and second panel, as is shown in FIG. 5B.

The first locking groove may also be arranged on the first panel with the displacement groove. Such embodiments are preferably provided with a displaceable and flexible tongue, which is fixed to parts of the displacement groove by glue. An inner part of the flexible and displaceable tongue is preferably glued to a bottom surface of the displacement groove. The inner part may also be glued to an upper and/or lower surface of the displacement groove 40.

Figure 6A:
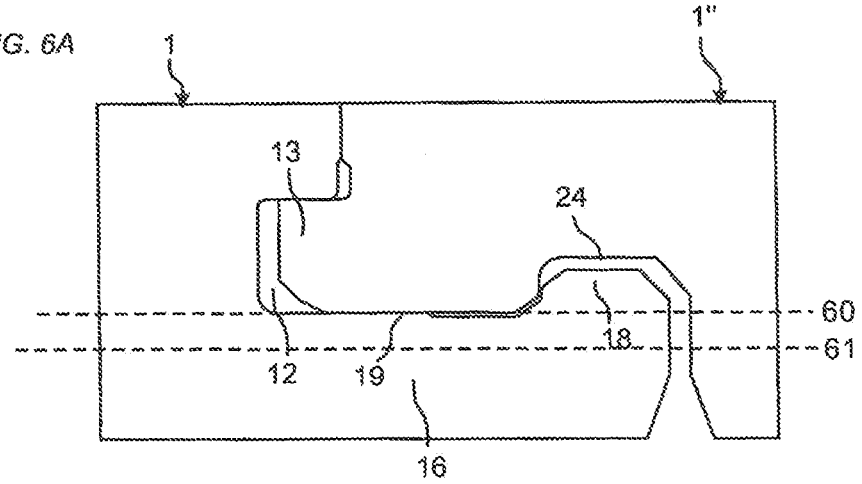
FIGS. 6A-6B show cross sections of long and short edges of panels according to an embodiment of the disclosure.
Figure 7A:
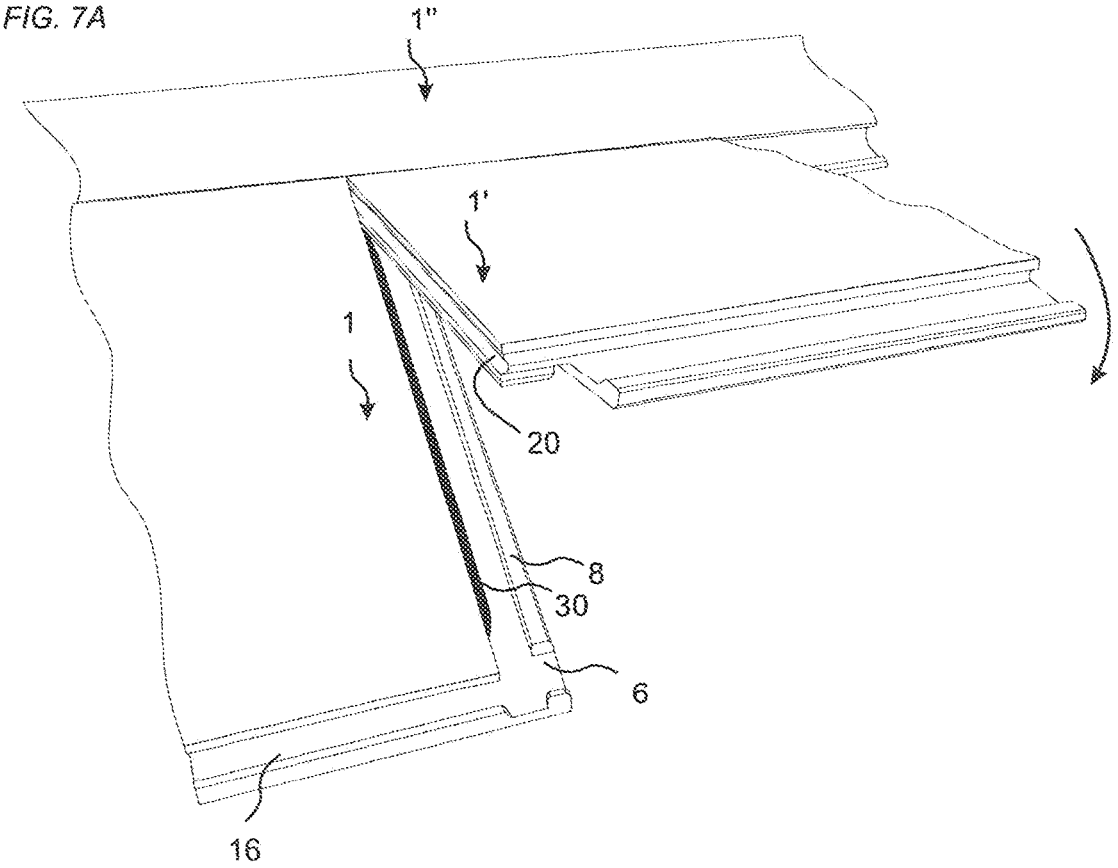
FIGS. 7A-7B show panels according to an embodiment of the disclosure.

Embodiments comprise a set of essentially identical panels comprising the first panel 1, the second panel 1' and a third panel 1", as shown in FIG. 7A. Each panel may be of a rectangular shape and the mechanical locking system may comprise a second locking strip 16, at a third edge 5*a*, provided with a second locking element 18, and a second locking groove 24 at a fourth edge 5*b*, as is shown in e.g. FIG. 6A and FIG. 7B. The second locking element 18 is configured to cooperate with the second locking groove 24 for locking of the third and the fourth edge in a horizontal direction. The mechanical locking system may comprise a second tongue groove 12 at a third edge 5*a* and a second tongue 13 at a fourth edge 5*b*. The second tongue and the second tongue groove are configured to cooperate for locking of the third and the fourth edge 5*a*, 5*b* in a horizontal direction. The fourth edge 5*b* is preferably provided with a lower edge surface configured to cooperate with a second upper surface of the second locking strip. The lower edge surface is therefore arranged in the same plane as the second upper surface of the second locking strip at the adjacent panel.

FIG. 7A shows an assembling of the second panel 1' to the first and the third panel 1, 1". The second panel 1' is angled around the fourth edge 5*b* of the second panel 1' to obtain simultaneously locking of the fourth edge 5*b* of the second panel 1' to the third edge 5*a* of the third panel 1" and the second edge 4*b* of the second panel 1' to the first edge 4*a* of the first panel 1'.

Figure 7B:
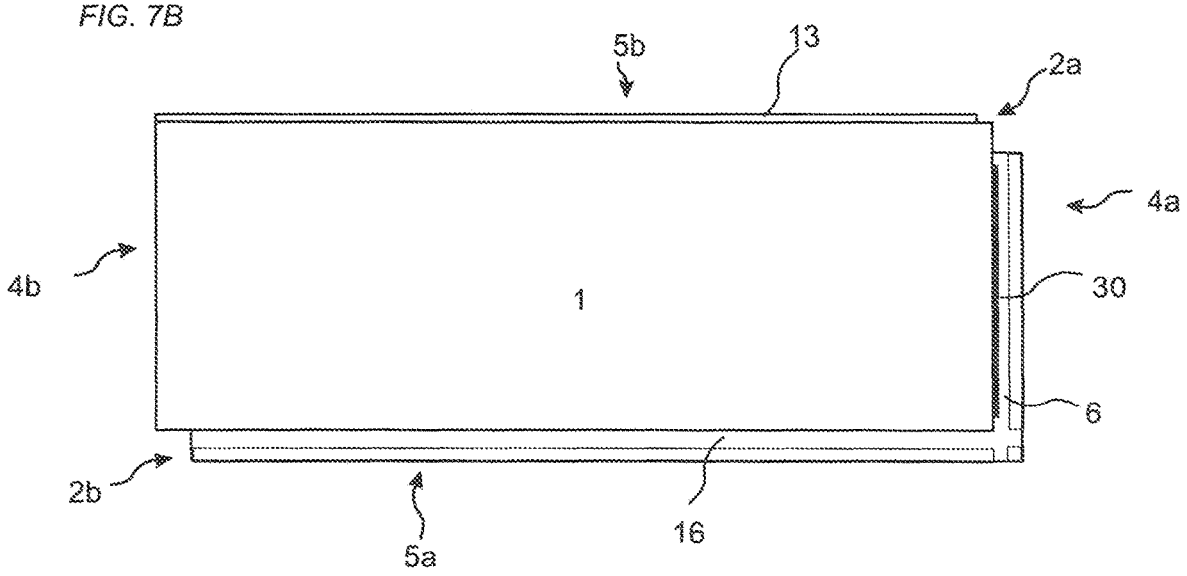

The first upper surface 9 of the first locking strip is preferably provided in a same plane as the second upper surface 19 of the second locking strip 16. The mechanical locking system at the third and the fourth edge 5*a*, 5*b* is normally produced before the mechanical locking system at the first and the second edge 4*a*, 4*b*. If said first and second upper surface are in the same plane or essentially in the same plane remainders of the mechanical locking system at the third and fourth edge 5*a*, 5*b*, at corners of the panel may be automatically removed. The remainders are generally thin and may later come loose, e.g. during packaging, transportation or assembling. An embodiment is shown in FIG. 7B with a first corner 2*a*, between the fourth edge 5*b* and the first edge 4*a*, and a second corner 2*b* between the third edge 5*a* and the second edge 4*b*. The remainder of the mechanical locking system at the fourth edge and the first corner 2*a* are automatically removed when forming the mechanical locking system at the first edge. The remainders of the mechanical locking system at the third edge and the second corner 2*b* are automatically removed when forming the mechanical locking system at the second edge.

Figure 6B:
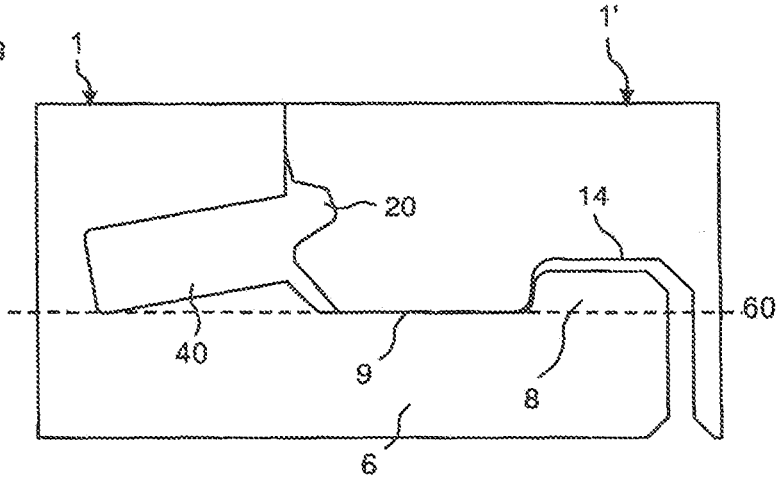

FIG. 6A shows a cross section of the third edge of the first panel 1 and the fourth edge of the third panel 1". The mechanical locking system at the third and the fourth edge comprises the second tongue 13 at the fourth edge and the second tongue groove 12 at the third edge. The third edge is provided with the second locking strip 16, protruding from the third edge, with the second locking element 18, and the fourth edge is provided with the second locking groove. The second upper surface 19 of the locking strip 16 is in contact with the lower surface of the fourth edge for locking in a vertical direction. The shown mechanical locking system at the third and the fourth edge is configured to be assembled and locked by an angling motion. The second upper surface is positioned in a horizontal plane 60. FIG. 6B shows a cross section of the first edge of the first panel and the second edge of the second panel. The first edge is provided with the first locking strip 6, protruding from the first edge, with a first locking element 8, and the second edge is provided with the first locking groove. The first upper surface 9 of the first locking strip is in contact with a lower surface of the second panel for locking in a vertical direction. The remainders of the mechanical locking system, at the third edge and the second corner and at the fourth edge and the first corner, may be automatically removed if said first and second upper surfaces are in the same horizontal plane 60. Unremoved remainders, such as the remainders 70 at the second corner shown in FIG. 1B, are generally thin and may later come loose, e.g. during packaging, transportation or assembling.

Figure 6C:
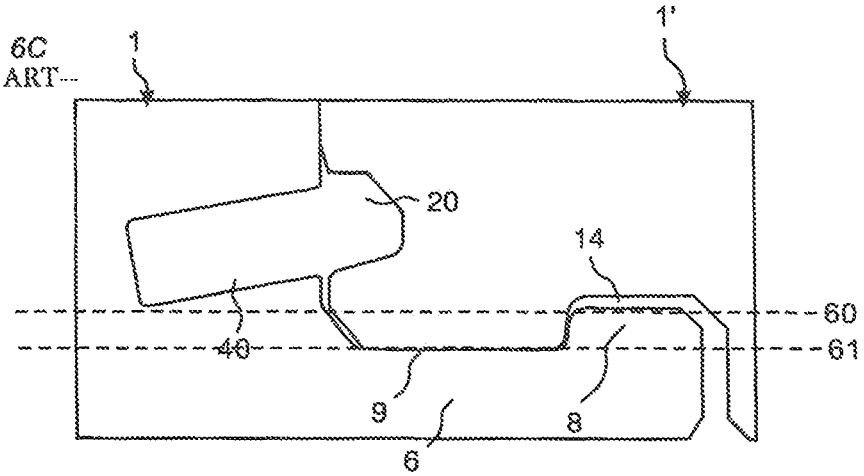
FIG. 6C shows a cross section of known panels.

The known mechanical locking system at the first and the second edges, as is shown in FIG. 6C, is provided with a first upper surface 9 at a lower horizontal plane 61 than the second upper surface at the third and the fourth edge. For the known mechanical locking system an additional operation is required to remove the remainder. The disclosure makes it possible to increase the thickness of the first locking strip and thereby arranging the first and the second upper surface in the same horizontal plane 60 without decreasing the distance 50 between the first locking groove 14 and the first tongue groove 20. This has the effect that the strength of the mechanical locking system is increased.

A preferred embodiment of the displaceable tongue 30 is shown in FIGS. 8A-8D. The displaceable tongue comprises several bendable parts 33. The bendable parts are provided with a lower and an upper friction connection 35 at a distance from the innermost part of the bendable part. The innermost part of the bendable parts 33 is provided with an upper and a lower bevel 39. The tongue is of a longitudinal shape and an outer edge of the displaceable tongue is preferably straight along essentially the whole longitudinal length of the displaceable tongue. An outer part 38 of the displaceable tongue is provided with a recess 31, which preferably extends along essentially the whole longitudinal length of the tongue. A first recess surface 81 of the recess is configured to cooperate with a first surface of the first tongue groove for locking in the vertical direction. A bevel 37 is provided at each end of the longitudinal edge, at a short edge of the displaceable tongue, to facilitate assembling of the first and the second panel by an angling movement. The tongue comprises a groove 34 at each bendable part 33. At least a part of the bendable part 33 is pushed into the groove 34 during assembling. The recess 31 may comprise a second recess surface 85, which is arranged at an obtuse angle to the first recess surface 81. An angle between an upper surface of the displaceable tongue and the first recess surface 81 may be in the range of about 5° to about 15°, preferably in the range of about 7° to about 8°.

Figure 8A:
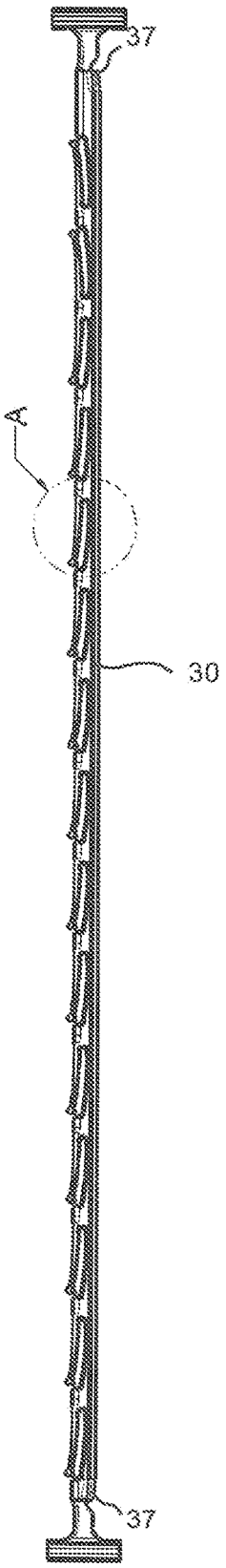
FIGS. 8A-8D show a displaceable tongue according to an embodiment of the disclosure.

The displaceable tongue is preferably produced by injection moulding and FIG. 8A shows casting gates at the short edges of the displaceable tongue.

Figure 8B:
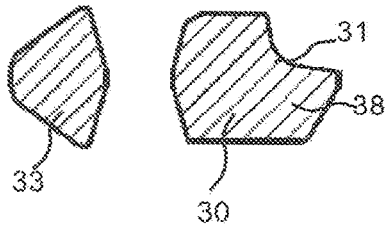
Figure 8C:
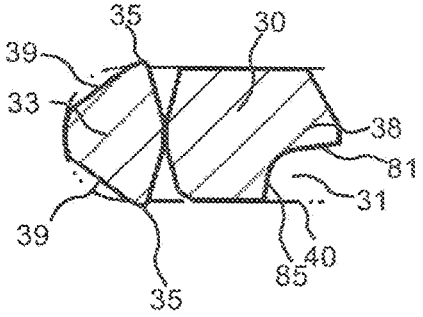
Figure 8D:
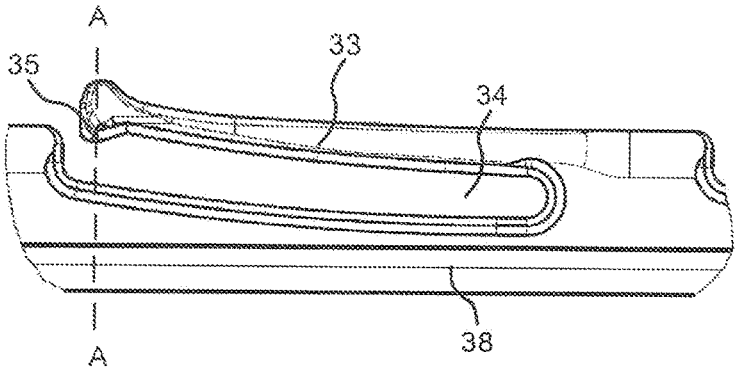

FIGS. 8B-8C are cross section views of the displaceable tongue shown in FIG. 8D, taken along line A-A in FIG. 8D (note that the relative vertical orientations of FIGS. 8B-8C are flipped). FIG. 8C shows displaceable tongue 30 arranged in the displacement groove 40 in a position during an assembling when the tongue is pushed into the displacement groove. The displacement groove 40 comprises an upper wall, a lower wall and an inner wall extending between the lower and the upper wall. The inner wall is of a rounded shape. The inner wall may as an alternative comprise a plane section provided with a round section adjacent to the upper and/or lower wall. The upper friction connection is configured to cooperate with a plane section of the upper wall. The lower friction connection is configured to cooperate with a plane section of the lower wall. An upper surface of the displaceable tongue may be configured to be displaced along the upper wall during assembling of the first and the second panel. A lower surface of the displaceable tongue may be configured to be displaced along the lower wall during assembling of the first and the second panel.

Figure 9A:
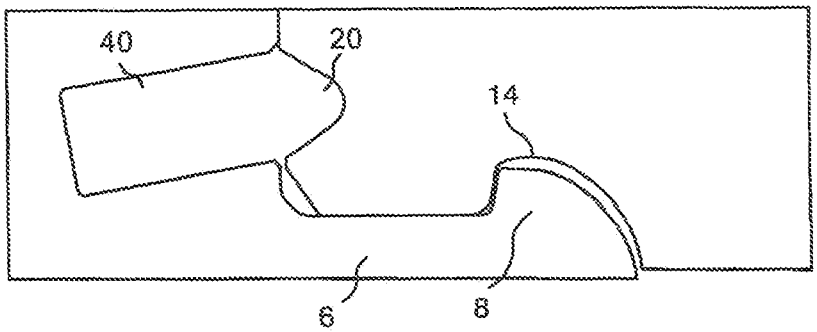
FIG. 9A shows a cross section of known panels.
Figure 9B:
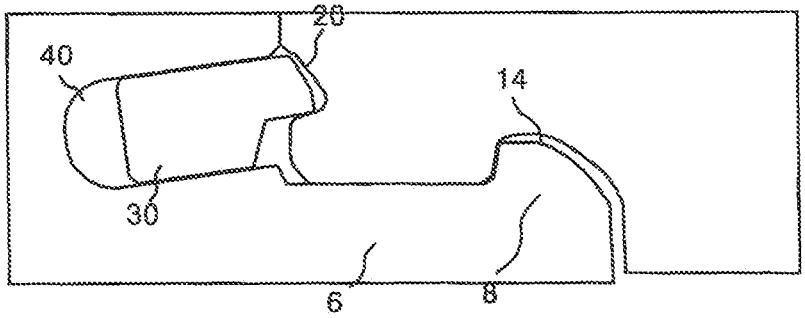
FIGS. 9B-9C show cross sections of embodiments of the disclosure.
Figure 9C:
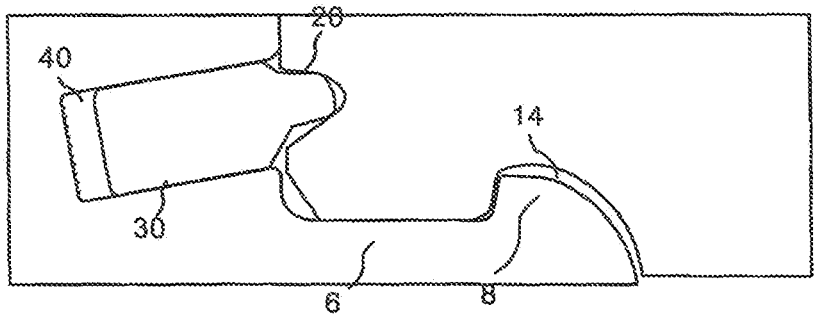

FIG. 9A shows another known mechanical locking system and FIG. 9B-C shows an improved version according to embodiments of the disclosure. The displaceable tongue 30 is provided with a recess at the outer part and the first tongue groove 20 is made smaller. The thickness of the locking strip 6 is increased and a bottom of the displacement groove 40 is provided with rounded corners. FIG. 9C shows that the upper and the lower outer part of the displaceable tongue may be provided with a recess. Particularly for floorboards of soft material, e.g. comprising a plastic core such as PVC, the joint is made stronger if both the upper and the lower outer part of the displaceable tongue are in contact with first tongue groove.

Figure 10A:
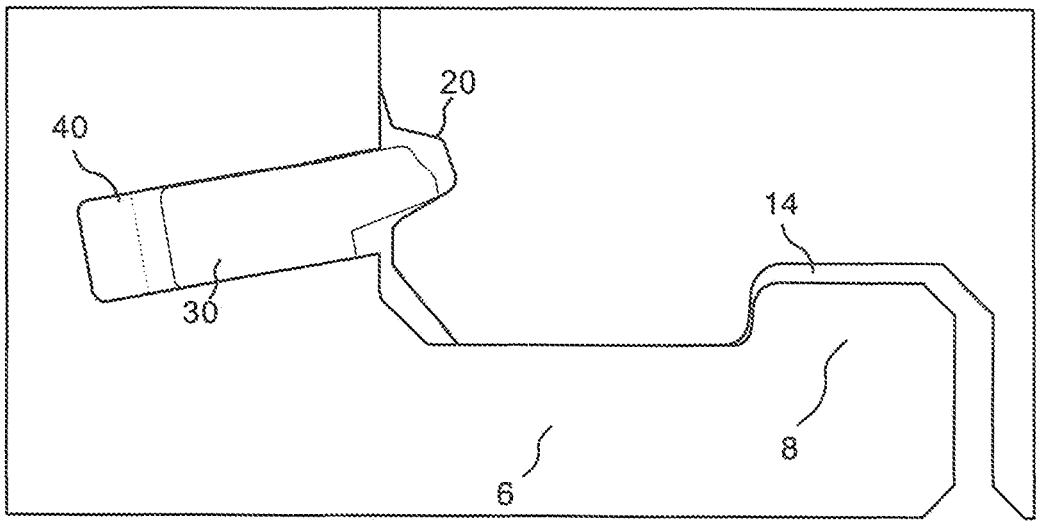
FIGS. 10A-10B show cross sections of embodiments of the disclosure.
Figure 10B:
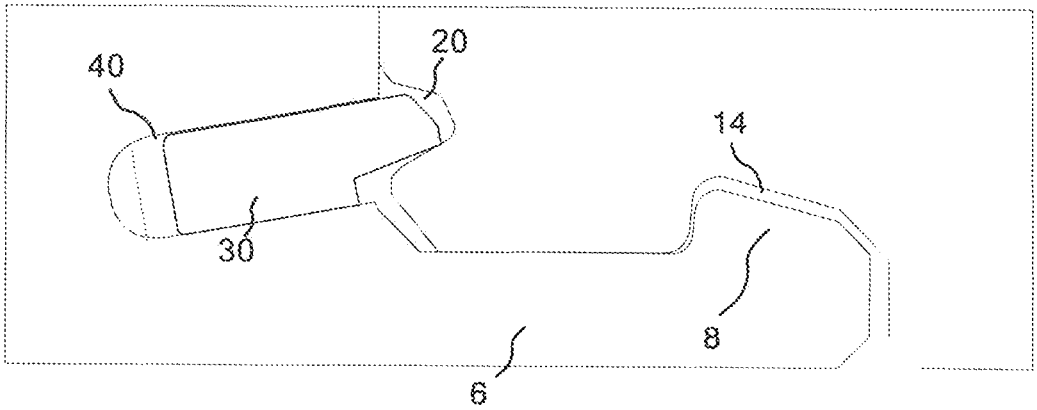

Further embodiments of the disclosure are shown in FIGS. 10A-10B. The benefits of the smaller first tongue groove 20 and the displaceable tongue 30 provided with a recess at the outer part are in the embodiment in FIG. 10A utilized to make the locking strip 6 thicker. FIG. 10B shows an embodiment with a displacement groove 40 provided with rounded corners and a locking groove 14 and locking element 8 provided with chamfered surfaces in order to further increase the strength of the locking system.

Figure 11A:
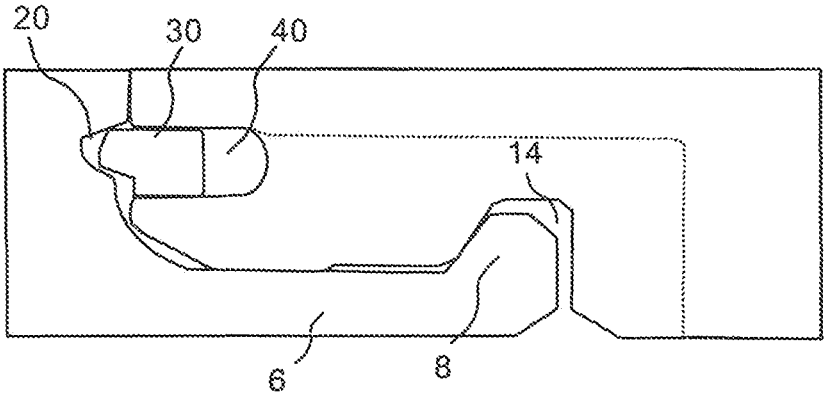
FIGS. 11A-11C show cross sections of embodiments of the disclosure.

FIG. 11A shows an embodiment which is of the type disclosed in WO2011/127981 with the displaceable tongue 30 arranged at the edge of the panel provided with the locking groove. The recess at the outer edge of the displaceable tongue is shown on the lower edge of the displaceable tongue but the recess may also be provided at the upper and outer edge of the displaceable tongue.

Figure 11B:
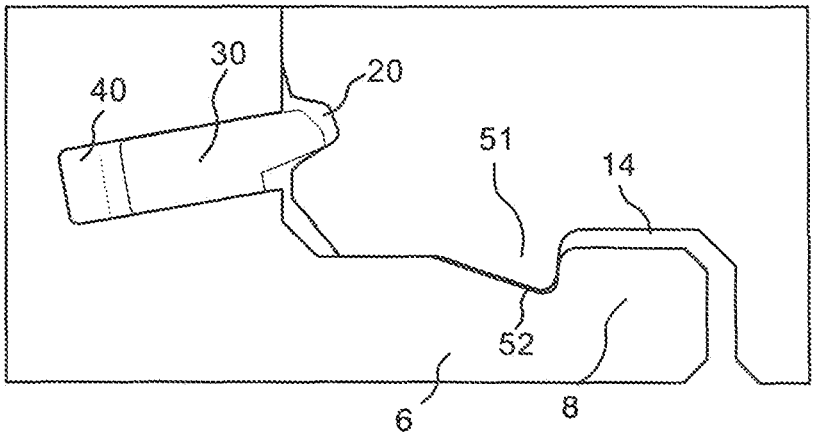
Figure 11C:
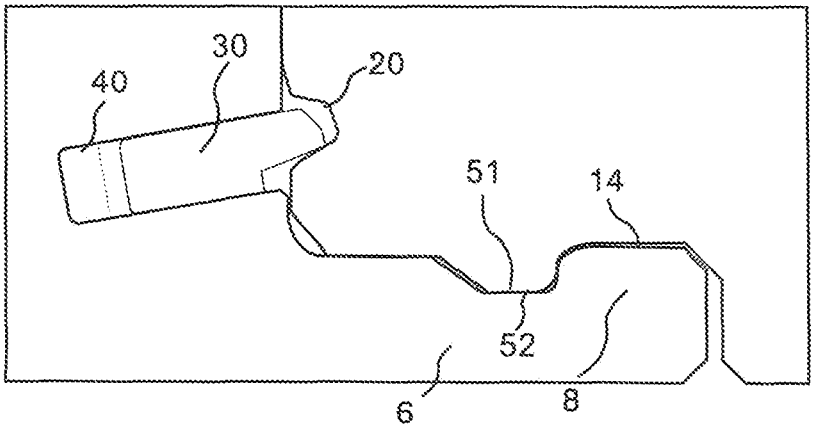

FIGS. 11B-11C show embodiments provided with a protruding part 51 at the lower side of the second edge. The protruding part 51 is configured to cooperate with a recess 52 at the upper side of the first locking strip and with the first locking element 8. Such configurations may increase the thickness of an inner part of the locking strip and the strength of the mechanical locking system.

Figure 12A:
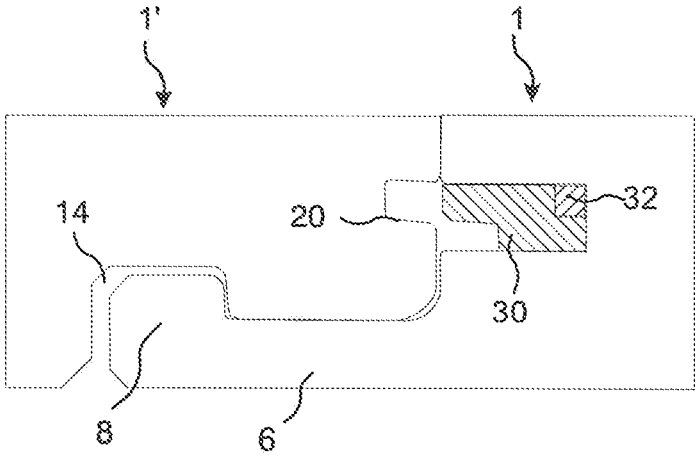
FIGS. 12A-12B show cross sections of an embodiment of the disclosure.
Figure 12B:
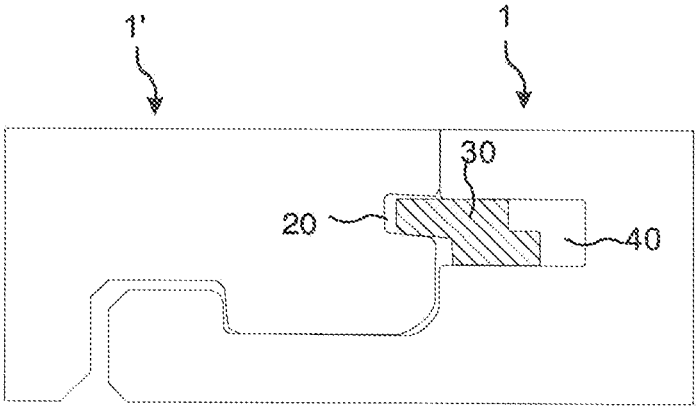

FIGS. 12A-12B show an embodiment comprising a displaceable tongue 30, which is configured to be locked by a displaceable element 31. The displaceable element may comprise a wedge shaped element (not shown) that pushes the displaceable tongue 30 into the first tongue groove 20 for vertical locking of the first and the second edge. The displaceable element may be displaced by pushing the displaceable element into 32 the displacement groove 40 along the second edge or by pulling the displaceable element along the second edge and out of the displacement groove 40. FIG. 12A shows the embodiment in an unlocked position and FIG. 12B shows the embodiment in a locked position.

Figure 13A:
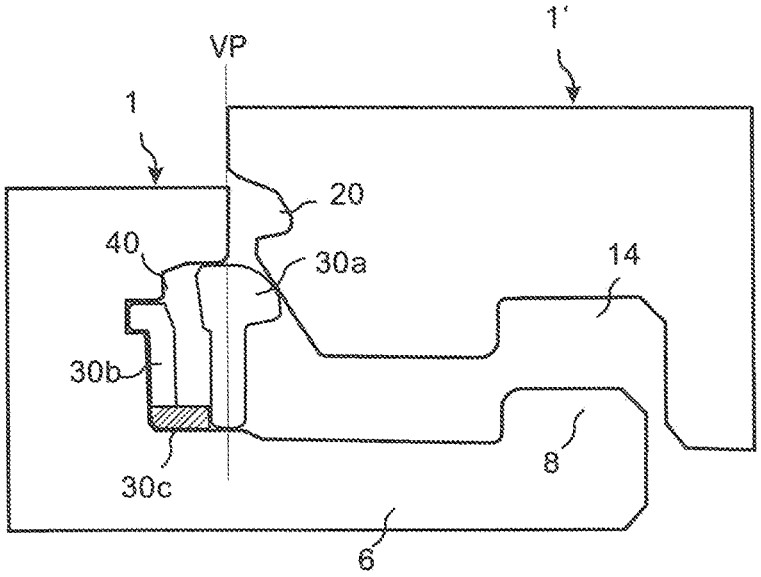
FIGS. 13A-13C show cross sections of an embodiment of the disclosure.
Figure 13B:
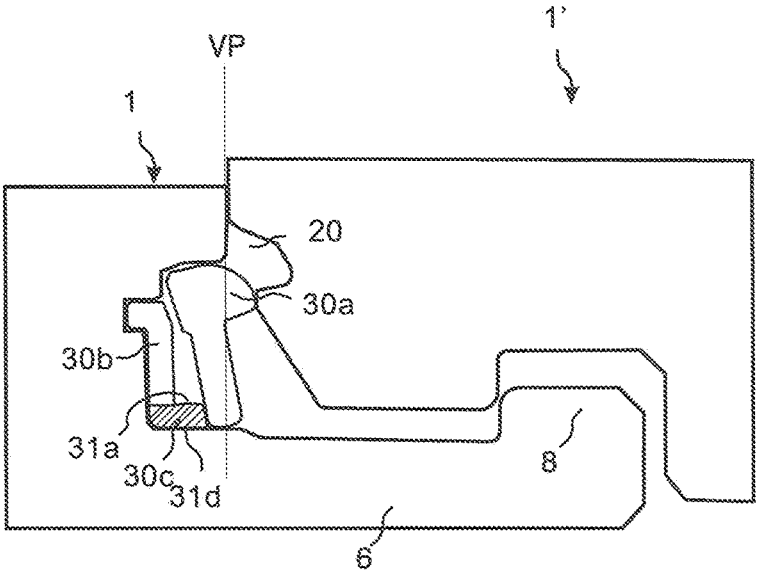
Figure 13C:
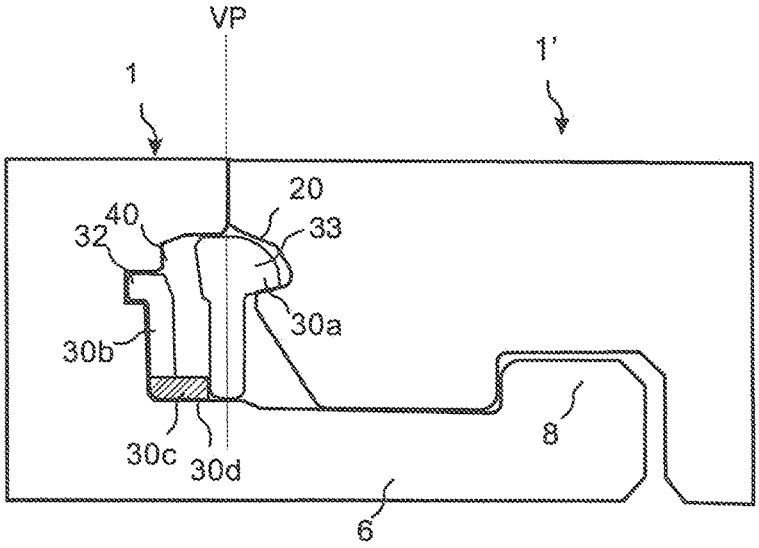

FIGS. 13A-13C show a displaceable tongue comprising three sections, an inner section 30*b*, an outer section 30*a* and a middle section 30*c* connected to each other. The sections are preferably formed from a plastic material. The outer and inner sections 30*a* and 30*b* are formed from a more rigid material than the middle section that provides the major flexibility to the flexible tongue. The middle section may be a rubber like material and may also be used as a friction connection in order to prevent that the flexible tongue falls out from the groove 40 after connection to a panel edge. The flexible middle section 30*c* is preferably located at a lower part of the flexible tongue. The middle section 30*c* comprises an upper part 31*a* that is compressed during locking and a lower part 31*b* that expands during locking. The outer part 30*a* protrudes preferably outside a vertical pane VP that intersects the upper adjacent joint edges of the panels 1, 1'. The locking system allows locking with low horizontal separation forces during locking. The vertical extension of the tongue groove 20 may be less than 0.5 times the vertical extension of the displacement groove 40. The inner part 30*b* comprises a fixing edge 32 that may be located at an upper or a lower part of the flexible tongue.

The flexible tongue may also be formed with only two sections, preferably without the more rigid inner section 30*b*. An outer section 30*a* may be connected to an inner section 30*d* that may have the same function as the above described middle section 30*c* and flexibility may be obtained with compression and extension of upper and lower parts of the flexible inner section when the outer section is turning inwards. This allows that the displacement groove may be smaller. Such a two sections tongue may also be used to lock panel according to the principles shown in FIGS. 2A-2C. The outer part 30*a* may point downwards when the flexible tongue 30 is located on a panel edge comprising a strip 6 (strip panel) and a locking element 8 and the flexible inner part 31*d* may be located at an upper part of the flexible tongue 30. The outer part 30*a* may point upwards when the flexible tongue 30 is connected to a panel edge comprising a locking groove (fold panel) and the flexible inner part 30*d* may be located at a lower part of the flexible tongue 30.

Figure 14A:
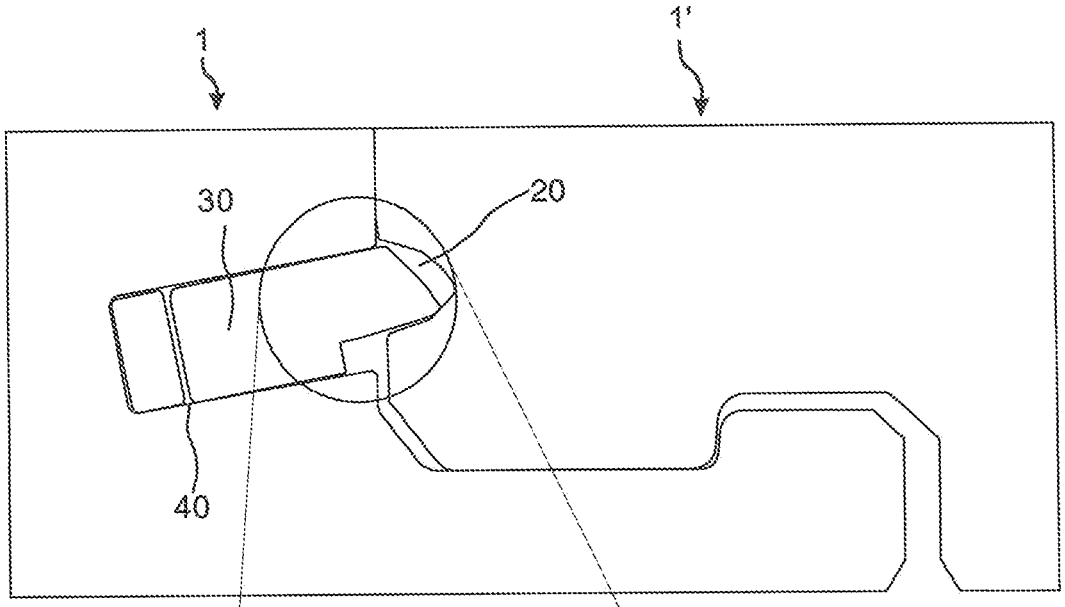
FIGS. 14A-14B show a cross section of an embodiment of the disclosure.
Figure 14B:
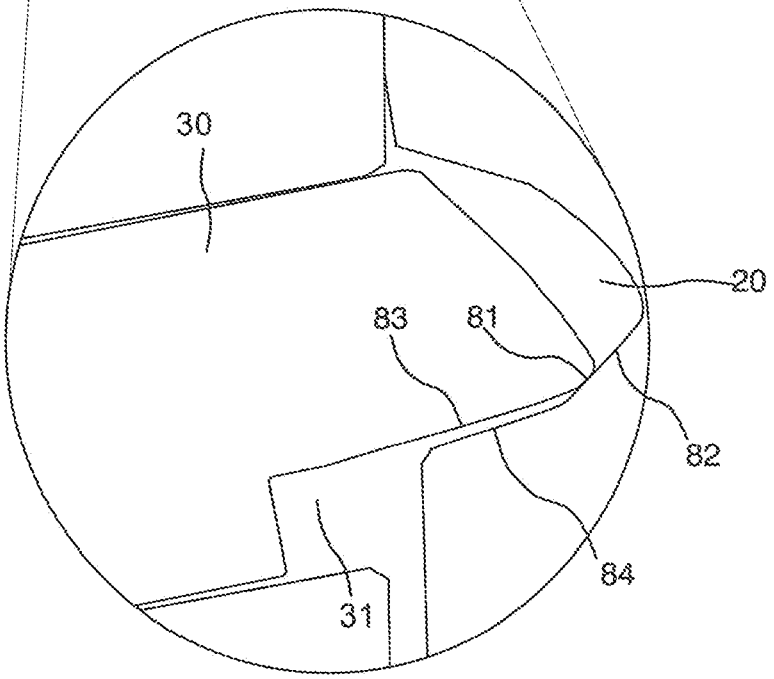

An embodiment of a mechanical locking system is shown in FIG. 14A and FIG. 14B shows an enlargement of the encircled area in FIG. 14B. The mechanical locking system comprises a displaceable tongue 30, which is arranged in a displacement groove 40 at a first edge of a first panel 1 and a first tongue groove 20 at a second edge of a second panel 1'. The displaceable tongue 30 is configured to cooperate with the first tongue groove, for locking in a vertical direction of the first and the second edge. At least a part of the displaceable tongue is preferably configured to be pushed into the displacement groove during assembling of the first and the second panel and spring back to a position in which a part of the displaceable tongue 30 cooperate with the first tongue groove 20 for the locking in the vertical direction. The displaceable tongue 30 comprises a first and a third surface 81,83 and the first tongue groove comprises a second and fourth surface 82,84. A first angle between the second surface 82 and a front face of the second panel 1' is greater than a second angle between the fourth surface 84 and the front face. The first surface of the displaceable tongue is configured to cooperate with the second surface of the tongue groove under a first load on the mechanical locking system. The third surface of the displaceable tongue is configured to cooperate with the fourth surface of the tongue groove under a second load on the mechanical locking system. The first load corresponds to a load under normal condition and the second load corresponds to an increased load when, for example, a chair, a sofa, or a bookcase is positioned on the first or the second panel. The first angle may have the advantage that a small displacement of the displaceable tongue pushes the first and the second panel together to the desired locked position, in which the front face of the second panel 1' is essentially in the same vertical position as a front face of the first panel 1. The second angle may have the advantage that the third and the fourth surface are able to carry a greater load and that the displaceable tongue is prevented from being pushed out from the first tongue groove. The first angle may be in the range of about 30° to about 45° and the second angle may be in the range of about 10° to about 25°. The difference between the first angle and the second angle may be in the range of about 10° to about 35°. An outer part of the displaceable tongue 30 is preferably provided with the recess 31 described above and the tongue groove is preferably smaller in height and depth than the displacement groove.

The invention claimed is:

1. A set of panels, provided with a mechanical locking system comprising:

a displaceable tongue, which is arranged in a displacement groove at a first edge of a first panel, a first tongue groove at a second edge of an adjacent second panel, the displaceable tongue being configured to cooperate with the first tongue groove for locking of the first and second edges in a vertical direction in a locked position, wherein the displacement groove comprises a first opening and the first tongue groove comprises a second opening, wherein at least a part of the displaceable tongue is configured to be pushed into the displacement groove during assembling of the first and second panels and spring back to a position in which an outer part of the displaceable tongue cooperate with the first tongue groove for the locking in the vertical direction in the locked position, wherein the first opening and the second opening are horizontally open and a vertical height of the first opening is greater than a vertical height of the second opening, wherein a longitudinal end and an opposite longitudinal end of the displaceable tongue each comprise a bevel, the bevel of the longitudinal end and the bevel of the opposite longitudinal end facing away from one another, wherein the panels are floorboards, and wherein an outer part of the displaceable tongue is provided with a recess which extends between the bevel at the longitudinal end of the displaceable tongue and the bevel at the opposite longitudinal end of the displaceable tongue.

2. The set as claimed in claim 1, wherein an upper surface of the displaceable tongue is configured to be displaced along an upper wall of the displacement groove during assembling of the first and second panels, wherein a lower surface of the displaceable tongue is configured to be displaced along a lower wall of the displacement groove during assembling of the first and second panels.

3. The set as claimed in claim 1, wherein the recess comprises a first recess surface and a second recess surface, the first and second recess surfaces being arranged at an obtuse angle to each other.

4. The set as claimed in claim 3, wherein the first recess surface of the recess is configured to cooperate with the first tongue groove for locking in the vertical direction in the locked position.

5. The set as claimed in claim 3, wherein an angle between an upper surface of the displaceable tongue and the first recess surface is in the range of about 5° to about 15°.

6. The set as claimed in claim 1, wherein a maximum height of the displacement groove is greater than a maximum height of the first tongue groove.

7. The set as claimed in claim 1, wherein a thickness of the panels is in the range of about 3 mm to about 10 mm.

8. The set as claimed in claim 1, wherein the mechanical locking system comprises a first locking strip, at the first edge or the second edge, provided with a first locking element configured to cooperate for horizontal locking with a first locking groove at the other of the first or second edge.

9. The set as claimed in claim 8, wherein the first locking strip is arranged at the first edge, and an outer and lower part of the displaceable tongue is provided with the recess.

10. The set as claimed in claim 8, wherein the panels are rectangular and the mechanical locking system comprises a second locking strip, at a third or fourth edge, provided with a second locking element configured to cooperate for horizontal locking with a second locking groove at the other of the third or fourth edge of an adjacent third panel.

11. The set as claimed in claim 10, wherein a first upper surface of the first locking strip is arranged in a same plane as a second upper surface of the second locking strip.

12. The set as claimed in claim 10, wherein the mechanical locking system at the third and the fourth edge is configured to be assembled by an angling motion.

13. The set as claimed in claim 1, wherein the mechanical locking system at the first and second edges is configured to be assembled by a vertical motion.

14. The set as claimed in claim 1, wherein the panels are floorboards comprising a wood fiber based core or a core comprising thermoplastic.

15. The set as claimed in claim 1, wherein the displaceable tongue is arranged in the displacement groove so that the displaceable tongue slides along a lower surface of the displacement groove in a direction toward and away from the adjacent second panel during locking.

16. The set as claimed in claim 1, wherein the first tongue groove extends vertically higher than does the displacement groove in the locked position.

17. The set as claimed in claim 1, wherein the displaceable tongue comprises at least two bendable parts.

18. The set as claimed in claim 17, wherein the displaceable tongue comprises a respective groove at each of the bendable parts.

19. The set as claimed in claim 18, wherein at least a part of the each of the bendable parts is configured to be pushed into the respective groove during assembling of the first and second panels.

* * * * *